US006749000B2

(12) United States Patent
Bohlen

(10) Patent No.: US 6,749,000 B2
(45) Date of Patent: Jun. 15, 2004

(54) SAFETY DEVICE FOR CORD-OPERATED CONTROL SYSTEM

(75) Inventor: Jorg Bohlen, Langen (DE)

(73) Assignee: Hunter Douglas Industries BV, El Rotterdam (NL)

( * ) Notice: Subject to any disclaimer, the term of this patent is extended or adjusted under 35 U.S.C. 154(b) by 10 days.

(21) Appl. No.: 10/321,738

(22) Filed: Dec. 16, 2002

(65) Prior Publication Data

US 2003/0145959 A1 Aug. 7, 2003

(30) Foreign Application Priority Data

Dec. 17, 2001 (EP) ..... 01204916
Apr. 8, 2002 (EP) ..... 02076366

(51) Int. Cl.[7] ..... A47G 5/02
(52) U.S. Cl. ..... 160/321; 160/178.1 R
(58) Field of Search ..... 160/321, 320, 160/319, 120, 170 R, 171 R, 344, 345, 178.1 R, 178.1 V

(56) References Cited

U.S. PATENT DOCUMENTS

| | | | | |
|---|---|---|---|---|
| 4,372,432 A | | 2/1983 | Waine et al. | 192/8 C |
| 4,418,739 A | * | 12/1983 | Woolnough et al. | 160/120 |
| RE31,793 E | | 1/1985 | Berman et al. | 160/309 |
| 4,534,396 A | | 8/1985 | Jung | 160/298 |
| 4,865,109 A | * | 9/1989 | Sherman | 160/321 |
| 5,029,629 A | | 7/1991 | Cheng-Pei | 160/300 |
| 5,137,073 A | | 8/1992 | Huang | 160/321 |
| 5,845,696 A | * | 12/1998 | Chou | 160/178.1 V |
| 6,158,563 A | | 12/2000 | Welfonder et al. | 192/223.3 |

FOREIGN PATENT DOCUMENTS

| | | |
|---|---|---|
| EP | 0869254 | 10/1998 |
| FR | 2 783 277 | 3/2000 |
| IT | 1261078 | 5/1996 |

* cited by examiner

*Primary Examiner*—David Purol
(74) *Attorney, Agent, or Firm*—Dorsey & Whitney LLP

(57) ABSTRACT

A cord-operated control system for a venetian blind, in which a housing, attached to the head rail, holds a first drive wheel that is operatively connected to a driven bind member that rotates in opposite directions to open and close the blind with rotation of the first drive wheel in opposite directions and a second drive wheel that is operatively connected to the first drive wheel, so that the first drive wheel rotates in opposite directions with rotation of the second drive wheel in opposite directions. An endless loop operating cord is looped over the second drive wheel, so that an axial pulling force on only one of the depending portions of the operating cord on opposite sides of the second drive wheel causes the second drive wheel to rotate in one of the opposite directions. As a safety feature, a release disconnects the drive wheels from each only if there is an axial pulling force on both depending portions of the operating cord simultaneously.

21 Claims, 13 Drawing Sheets

SAFETY DEVICE FOR CORD-OPERATED CONTROL SYSTEM

CROSS REFERENCE TO RELATED APPLICATIONS

This application claims priority to European Application No. 01204916.9 filed Dec. 17, 2001 and European Application No. 02076366 filed Apr. 8, 2002. Each of the above-identified patent applications is hereby incorporated by reference as if fully disclosed herein.

BACKGROUND OF THE INVENTION

1. Field of the Invention

This invention relates generally to a control system for operating and positioning a covering for an architectural opening, such as a window blind (e.g., a horizontal or vertical venetian blind). This invention particularly relates to a control system which includes a drive wheel for positioning a blind and an endless-loop operating cord, looped over the drive wheel, so that depending portions of the cord are on opposite sides of the drive wheel. This invention quite particularly relates to a safety device for such a control system that includes means for allowing the cord to be detached from the drive wheel when a generally downward force is exerted simultaneously on both depending portions of the cord.

2. Description of the Relevant Art

Means for releasing an endless-loop operating cord, in its entirety, from a control system of a window blind to ensure the safety of children that might become entangled in the cord are described in EP 0 869 254. The operating cord of EP 0 869 254 depends from opposite sides of a drive wheel but is not looped over the drive wheel. Rather, its operating cord is slidably attached to a mounting plate, which is releasably mounted on a mounting support, and the cord is kept in operative engagement with the lower half of the drive wheel by the mounting plate. When both depending portions of the cord are pulled at the same time, the mounting plate is released from the mounting support, thereby releasing the cord from the control system, thereby preventing possible injury to a child whose head may have become entangled in the cord.

However a drawback of the system of EP 0 869 254 is that since its operating cord is not slung over its drive wheel as is conventional, extra parts (at extra cost) must be provided to guide and maintain the cord in operative engagement with the drive wheel. These extra parts include the mounting plate, mounting support and a pair of pulleys located on the mounting plate. This system is also less energy efficient in positioning the blind, for a given effort pulling downwardly on one depending portion of the cord. Furthermore, the extra parts make failure of the control system, in routine operation of the blind, more likely.

BRIEF SUMMARY OF THE INVENTION

In accordance with this invention, a cord-operated control system for a covering for an architectural opening is provided which includes:

a housing;

a first drive wheel that is operatively connected to a driven blind member, adapted to rotate in opposite directions to open and close the covering; the first drive wheel being adapted to rotate in opposite directions and being connected to the driven blind member, so that the driven blind member rotates with the first drive wheel;

a second drive wheel that is adapted to rotate in opposite directions within the housing, is rotatably connected to the housing and is operatively connected to the first drive wheel, so that the first drive wheel rotates with the second drive wheel;

an operating cord that is an endless loop and is looped over the second drive wheel and has first and second, cord portions depending from opposite sides of the second drive wheel, whereby an axial pulling force on only the first cord portion causes the second drive wheel to rotate in a first direction and an axial pulling force on only the second cord portion causes the second drive wheel to rotate in an opposite second direction; and release means for disconnecting, preferably non-destructively disconnecting, the second drive wheel from the first drive wheel only when there is an axial pulling force on both the first and second cord portions simultaneously.

In one advantageous embodiment, both the first and second drive wheels are rotatably mounted in the housing, and the release means are for dismounting the second drive wheel from the housing when there is the axial pulling force on both the first and second cord portions simultaneously.

In a further advantageous embodiment, the second drive wheel is operatively connected to the first drive wheel by a third drive wheel and an auxiliary operating cord. Advantageously, both the second drive wheel and the third drive wheel are rotatably mounted in the housing, the auxiliary drive cord is an endless loop and is looped over the first drive wheel and the third drive wheel to operatively connect them, and wherein, when the second drive wheel is rotated, it causes the third drive wheel to rotate, which in turn causes the auxiliary operating cord to drive the first drive wheel to rotate and thus causes the driven member to rotate.

In a still further advantageous embodiment, the release means are for disconnecting a lower portion of the housing with a drive wheel from an upper portion of the housing with another drive wheel. Advantageously, the release means comprises a releasable snap engagement arrangement between the lower and upper housing portions.

In a yet further advantageous embodiment, the second and third drive wheels are coaxially connected, and the release means are for disconnecting the coaxially-connected, second and third drive wheels. Advantageously, the release means comprises a releasable snap fit arrangement between the second and third drive wheels.

Further aspects of the invention will be apparent from the detailed description below of particular embodiments and the drawings thereof.

DETAILED DESCRIPTION OF THE INVENTION

Figure 1:
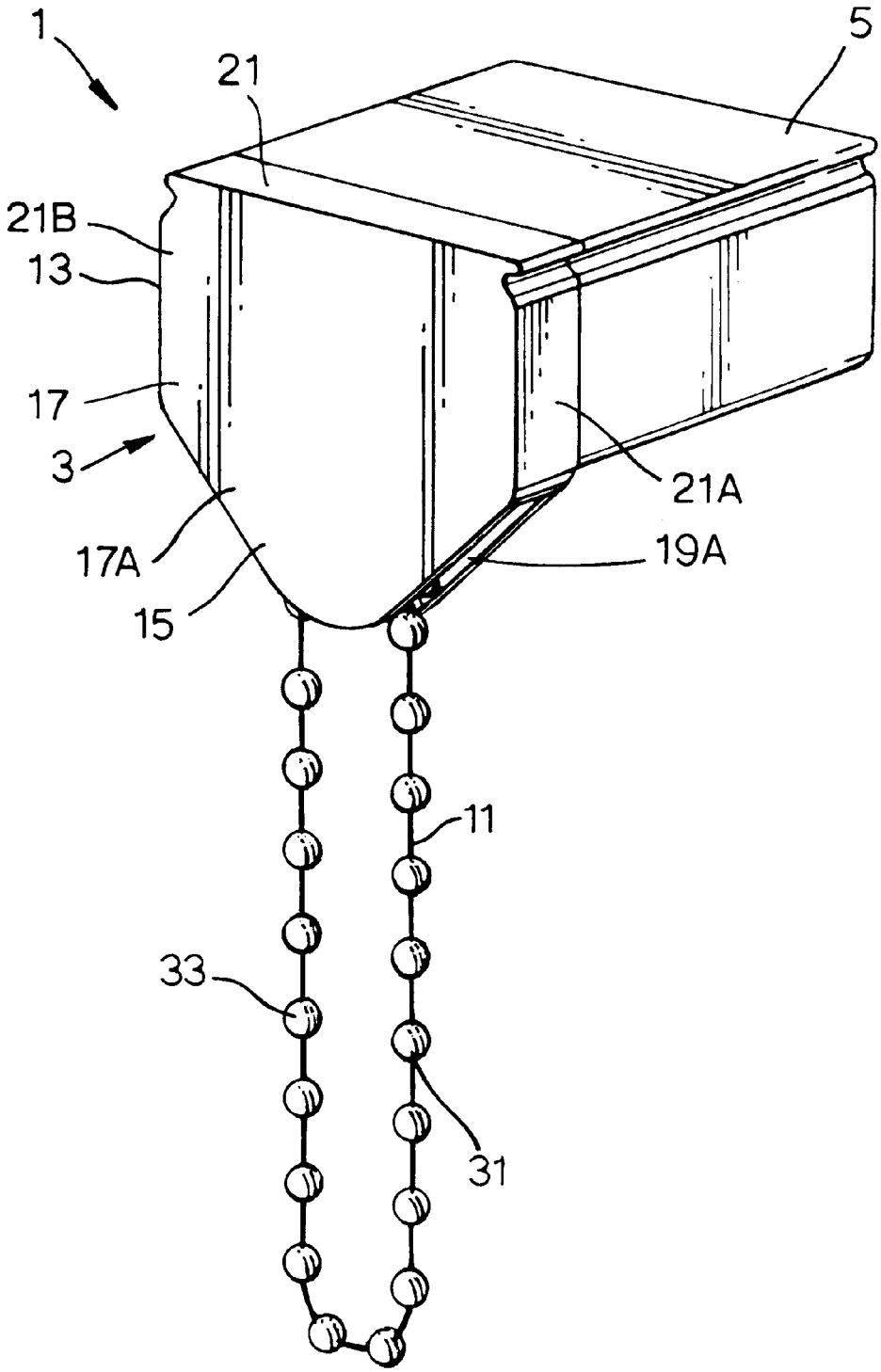
FIG. 1 is a perspective view of a first embodiment of the control system of this invention in its housing on a head rail of a venetian blind.
Figure 2:
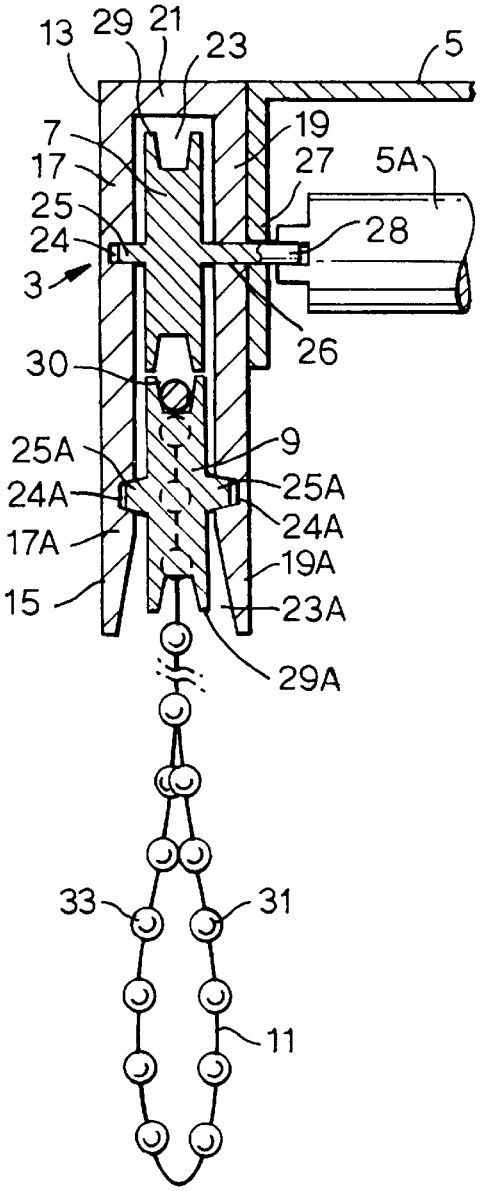
FIG. 2 is a sectional view of the first embodiment of the control system, taken along a longitudinally-extending plane through the housing as shown in FIG. 1; a lower drive wheel (not in section) in the housing, with an operating cord looped (not in section) about it, is engaged with an upper drive wheel (not in section) in the housing and thereby with the rest of the system.

FIGS. 1 and 2 show a control system 1 of this invention in a housing 3, mounted as an end cap on a longitudinally-extending head rail 5 of a venetian blind (not shown). The control system 1 includes a first or upper drive wheel 7, a second or lower drive wheel 9 and a conventional closed loop or endless-loop, operating cord 11, such as a bead chain, which functions as an operating element of the blind. The upper drive wheel 7 is operatively connected to a conventional, longitudinally-extending, driven member 5A, rotation of which causes movement of the blind, such as a traversing, lifting and/or tilting movement of the blind slats. For example, the driven member 5A can be a conventional drive shaft of a roller blind, central control shaft for a roman shade, lift or tilt shaft of a horizontal venetian blind or tilt shaft of a vertical venetian blind. Looped about the second drive wheel 9 is the operating cord 11.

The housing 3, which accommodates the upper and lower, drive wheels 7,9, has an upper or first housing portion 13 and a lower or second housing portion 15. The upper housing portion 13 comprises an upstanding, laterally-extending, upper left (as shown in FIGS. 1–2) wall portion 17, remote from the head rail 5, and an upstanding, laterally-extending, upper right (as shown in FIGS. 1–2) wall portion 19, adjacent the head rail 5. The upper wall portions 17,19 are connected by a horizontally-extending top bridging wall member 21, atop the upper wall portions 17,19, and a pair of upstanding, front and back, bridging wall members 21A, 21B, at the lateral sides of the upper wall portions 17,19, thereby defining an upper space 23 between the upper wall portions 17,19 for accommodating the upper drive wheel 7. The upper housing portion 13 and the head rail 5 preferably have the same profile when viewed from a longitudinal end of the head rail. The lower housing portion 15 likewise comprises an upstanding, laterally-extending, lower left wall portion 17A and an upstanding, laterally-extending, lower right wall portion 19A. The lower wall portions 17A, 19A extend downwardly form the upper wall portions 17, 19 but are not connected by bridging wall members either on their lateral sides or on their top or bottom. However, by virtue of the top wall bridging member 21 and the front and back, bridging wall members 21A, 21B, a lower space 23A is defined between the lower wall portions 17A,19A, beneath the upper space 23. The lower space 23A accommodates the lower drive wheel 9 and the upper portions of the operating cord 11, passing laterally over the lower drive wheel. Preferably the laterally-extending width of each of the lower, left and right, wall portions 17A, 19A is gradually reduced from its top to its bottom, thus providing these wall portions with a generally semi-circular or triangular form with the narrowest part being the lowermost part. Preferably, the lower left and right wall portions 17A,19A have equal laterally-extending widths that are somewhat greater than the laterally-extending width of the lower drive wheel. Of course, the upper and lower, left wall portions 17, 17A, and upper and lower, right wall portions 19 and 19A can be integrally shaped into respectively a left wall and a right wall.

The upper and lower drive wheels 7, 9 are rotatably mounted in the housing 3 in a generally conventional manner, as described, for example, in U.S. Pat. No. 6,158,563 or U.S. Pat. No. 4,372,432. In this regard, mounting journals or stub axles on opposite sides of the drive wheels 7, 9 or on the upper and lower wall portions 17, 17A, 19, 19A are rotatably accommodated in complementary coaxial bearings or journal bores in the wall portions or in opposite sides of the drive wheels, respectively.

As shown in FIG. 2, it is preferred that the upper drive wheel 7 be rotatably mounted as follows in the upper housing portion 13. The inner surface of the upper left wall portion 17 has a longitudinally-extending upper left bearing 24, in which is positioned a corresponding coaxial upper left journal 25, located at the center of the left side of the upper drive wheel 7. Extending longitudinally through the upper right wall portion 19 is an upper right bearing 26, which is coaxial with the upper left bearing 24, and extending longitudinally through the left side of the head rail 5 is a bearing 27 that is adjacent to, and coaxial, with the upper right bearing 26 and the driven member 5A. Positioned in the adjacent bearings 26, 27 is a corresponding coaxial upper right journal 28. The upper right journal 28 is located at the center of the right side of the upper drive wheel 7 and is connected to the driven member 5A, so that the upper drive wheel and the driven member are operatively connected to rotate together.

As also shown in FIG. 2, it is also preferred that the lower drive wheel 9 be rotatably mounted in the lower housing portion 15. The inner surfaces of the lower, left and right wall portions 17A,19A have coaxial longitudinally-extending lower bearings 24A, in each of which is positioned one of a pair of corresponding coaxial lower journals 25A, located at the center of the left and right sides of the lower drive wheel 9.

The upper drive wheel 7 is operatively connected to the lower drive wheel 9, so that rotation of the lower drive wheel 9 causes rotation of the upper drive wheel 7. Preferably, the circumference of each of the drive wheels 7,9 is provided with gear teeth 29, 29A, respectively, and the gear teeth 29 of the upper drive wheel 7 interact with the gear teeth 29A of the lower drive wheel 9, so that the two drive wheels 7,9 rotate together.

The lower drive wheel 9 is adapted to accommodate the operating cord 11 which is looped about and engages the circumference of the lower drive wheel. In this regard, the lower drive wheel 9 can be a simple pulley for a cord or have an exterior rim that is specially shaped with a circumferential groove 30 to receive the operating cord 11. The operating cord 11 has two depending portions 31, 33 on laterally opposite sides of the lower drive wheel 9.

In accordance with this invention, the lower drive wheel 9 is releasably mounted in the lower housing portion 15. In this regard, it is preferred that each lower bearing 24A preferably has a beveled edge or rim and/or that each corresponding lower journal 25A has a beveled edge. Additionally, the left and right walls 17, 17A, 19, 19A, particularly the lower, left and right, wall portions 17A,19A, of the housing 3 are relatively flexible and resilient. This relative flexibility and resilience are a function of the lack of bridging wall members between the lower wall portions 17A, 19A. This relative flexibility and resilience are also a function of the relative longitudinal thinness of one or preferably both of the lower, left and right lower wall portions 17A, 19A.

The lower drive wheel 9 is normally held in place in the housing 3—so that the lower drive wheel is operatively connected to the upper drive wheel 7 and thereby to the rest of the control system 1—by the lower, left and right, wall portions 17A,19A of the housing 3 and by the engagement of the lower journals 25A with the lower bearings 24A. Indeed, when the lower drive wheel 9 is mounted in the control system 1 by pushing the lower drive wheel 9 upwardly between the flexible, lower, left and right, wall portions 17A,19A, towards the lower bearings 24A, the lower journals 25A force the lower, left and right, wall portions 17A,19A slightly apart before the lower journals lodge in their respective lower bearings with the beveled edges of the lower journals bearing on the beveled rims of the lower bearings. Then, the resilience of the lower wall portions 17A,19A bias the lower wall portions to move towards each other and to their neutral positions (as shown in FIG. 2) by producing a longitudinally inwardly-directed biasing force on the lower wall portions. This resilience serves thereafter to hold the lower drive wheel 9 rotatably in the lower space 23A and operatively connected to the upper drive wheel 7 and, thereby, to the driving member 5A.

Preferably, the longitudinal width of the lower drive wheel 9 at its widest portion, including the beveled lower journals 25A, is slightly larger than the largest width of the lower space 23A of the lower housing portion 15. The largest width of the lower space 23A is preferably where the lower bearings 24A are located because this width includes the longitudinal depth of the lower bearings. Nevertheless, the largest width of the lower space 23A is still smaller than the widest part of the lower drive wheel 9 where the lower journals 25A are located. Thereby, after the lower journals 25A of the lower drive wheel 9 snap into the lower bearings 24A of the lower housing portion 15 (when the lower drive wheel is pushed between the flexible, lower wall portions 17A,19A, towards the lower bearings), the resilience of the lower wall portions thereafter holds the lower drive wheel in place in the lower housing portion 15 during normal operation of the operating cord 11 when there is an axial pulling force downwardly on only its first or second cord portion 31 or 33.

However if both the first and second cord portions 31, 33 are pulled downwardly simultaneously by a force that exceeds a predetermined value—for example, in the unlikely event a child gets entangled in the bottom loop of the operating cord 11—the downward force on the operating cord produces a longitudinally outwardly-directed force acting through the beveled edges of both lower journals 25A bearing downwardly on the beveled rims of the lower bearings 24A. This longitudinally outwardly-directed force will cause the flexible, lower, left and right, wall portions 17A,19A, of the housing 3 to be pushed longitudinally apart from each other, and the lower wall portions may also be slightly bent temporarily by such force but without permanent bend lines forming in the lower wall portions. As the lower wall portions 17A,19A are separated in a longitudinal direction, the lower journals 25A will slide downwardly out of their lower bearings 24A. Continued downward pulling on both the first and second cord portions 31, 33 will pull the lower drive wheel 9, together with the operating cord 11, downwardly and out from between the walls 17, 19 of the housing 3, thereby disconnecting, the lower drive wheel 9 and the operating cord from the upper drive wheel 7 and hence from the rest of the control system 1.

After the lower drive wheel 9, with the operating cord 11, has been disengaged from the upper drive wheel 7 by a downward force on both the first and second cord portions 31, 33, the lower drive wheel and operating cord can be pushed back into the housing 3 and operatively reconnected to the upper drive wheel and the rest of the control system 1. This can be done simply by pushing the lower drive wheel 9 with the operating cord 11 upwardly into the lower housing portion 15, so that its lower journals 25A are again in the lower bearings 24A. In this regard, pushing the lower journals 25A back into the lower bearings 24A is easier if the lower journals or the lower bearings or both have beveled edges.

In accordance with this invention, the design and construction of the elements of the control system 1 can be varied to vary the required amount of downward force, applied simultaneously to the first and second cord portions 31, 33, in order to disconnect the lower drive wheel 9 from the upper drive wheel 7. For example, the angle of the beveled edges of the lower journals 25A, the angle of the beveled edges of the lower bearings 24A, the shape and dimensions of the lower journals and lower bearings and/or the relative flexibility and resilience of the left and right, wall portions 17A,19A, of the housing 3 can affect the amount of downward force on the first and second cord portions 31, 33 necessary to release the lower drive wheel 9 from engagement with the upper drive wheel 7. In this regard, the more rigid the lower wall portions 17A,19A, the more force required to release the lower drive wheel 9. Also if both the edges of the lower bearings 24A and the lower journals 25A are beveled at a greater angle (relative to horizontal), less force is likely to be required to release the lower drive wheel 9. Likewise if both the lower bearings 24A and the lower journals 25A are longitudinally longer, it will be more difficult to release the lower drive wheel 9. Also, the thickness, as well as the choice of materials, of the housing 3, particularly its lower wall portions 17A,19A, can be varied to vary the flexibility and resilience of the lower wall portions.

If desired, conventional clutches and/or brakes for regulating the rotation of the driven member 5A, in response to rotation of the upper drive wheel 7 or the weight of the blind, can be provided in the head rail 5. These can be of the type disclosed by, for example, U.S. Pat. Nos. 4,372,432 and 6,158,563.

Figure 3:
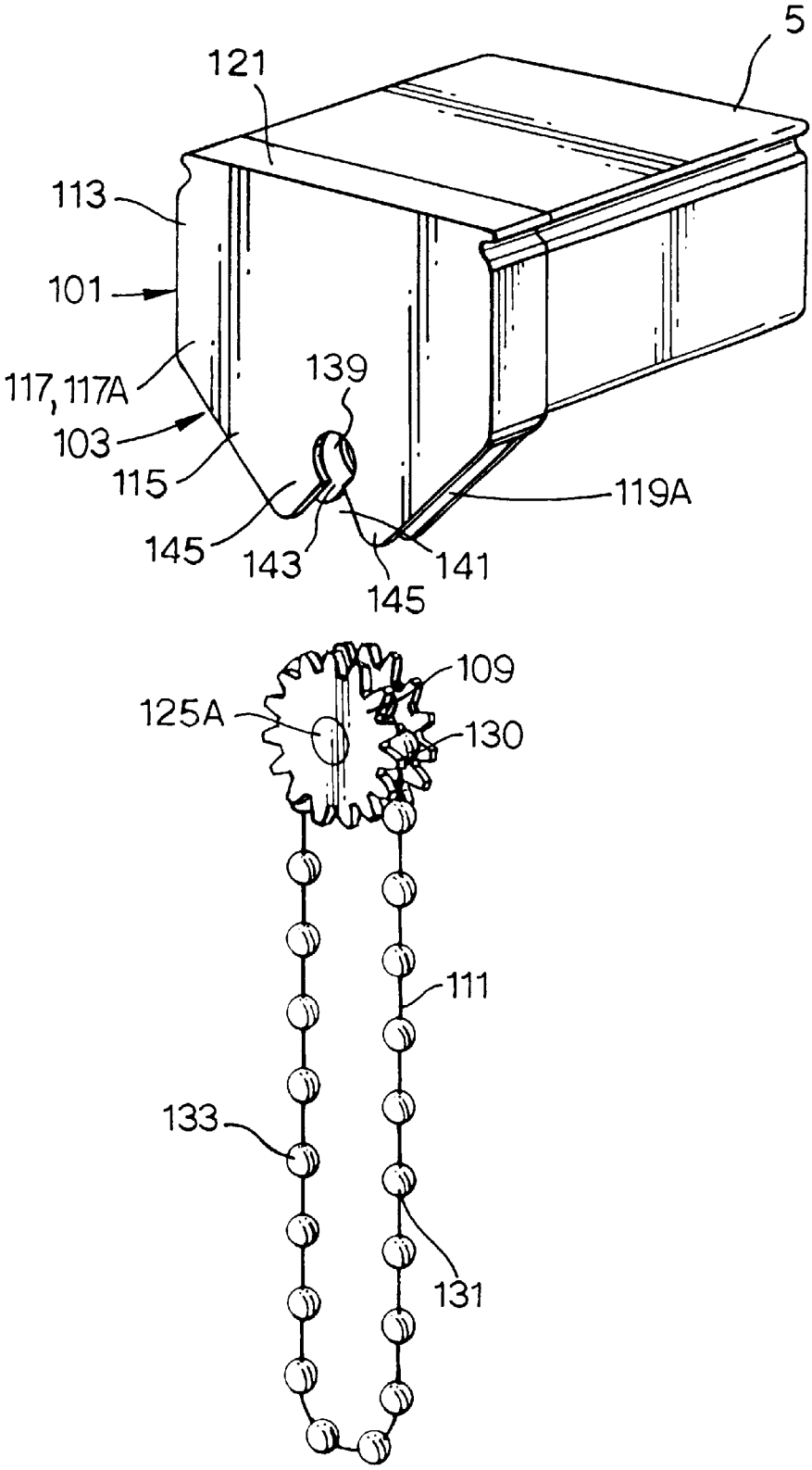
FIG. 3 is a perspective view, similar to FIG. 1, of a second embodiment of the control system of this invention in its housing on a head rail of a venetian blind; a drive wheel of the control system, with an operating cord looped about it, has been disconnected from the rest of the system.

FIG. 3 shows a second embodiment 101 of a control system of this invention which is similar to the control system 1 of FIGS. 1 and 2 and for which corresponding reference numerals (greater by 100) are used below for describing the same or corresponding parts.

The control system 101 is in a housing 103, mounted as an end cap on a head rail 105 of a venetian blind (not shown). The control system 101 includes: an upper drive wheel (not shown), rotatably mounted in an upper portion 113 of the housing 103 and operatively connected to a driven member (not shown); a lower drive wheel 109, rotatably connected to a lower portion 115 of the housing 103 and operatively connected to the upper drive wheel; and an endless-loop, operating cord 111, looped over the lower drive wheel.

The inner surfaces of the lower, left and right, wall portions 117A,119A of the lower housing portion 115 each have a lower journal bore or bearing 124A that extends longitudinally completely through the wall portion and is complementary to a corresponding, longitudinally-extending, lower journal or stub axle 125A on each of the left and right sides of the lower drive wheel 109. To make the lower drive wheel 109 releasably mounted in the lower housing portion 115, each lower journal bore 124A has a keyhole shape that is open at the bottom of its lower wall portion 117A,119A. In this regard, each keyhole-shaped lower bearing 124A has an upper, generally circular portion 139 that has a diameter greater than each lower journal 125A and a lower, downwardly-extending, stem portion 141 that is open at the bottom. The circular portion 139 of each lower bearing 124A is adapted to hold one of the lower journals 125A of the lower drive wheel 109 during normal operation of the control system 101. The lateral sides of the stem portion 141 of each lower bearing 124A diverge laterally and downwardly from beneath the upper, circular portion 139 where the lateral sides are relatively close and form a restricted opening 143 in its lower wall portion 117A,119A at the upper end of the stem portion. The lateral width of this restricted opening 143 is preferably less than the diameter of each journal 125A. The diverging sides of each tapered stem portion 141 of a lower bearing 124A form two fingers 145 on laterally-opposite sides of the of the lower bearing. In accordance with this invention, the lower, left and right, wall portions 117A,119A, particularly the fingers 145, are relatively flexible and resilient.

In order to better hold the lower journals 125A of the lower drive wheel 109 in the circular portions 139 of the lower bearings 124A, each lower journal preferably has a circumferential groove (not shown) near its longitudinal end. The groove of each lower journal engages longitudinally the left and right sides of the adjacent lower wall portion 117A,119A, about the circular portion of the lower bearing, in which the lower journal is held, and thereby prevents undesired longitudinal slippage of the lower drive wheel.

A downward pulling force simultaneously on both the first and second depending portions 131, 133 of the operating cord 111 can pull the lower journals 125A of the lower drive wheel 109 downwardly, out of the circular portions 139 of the lower bearings 124A through their restricted openings 143, then through their stem portions 141 and finally out the bottom of the stem portions. In this regard, the two flexible and resilient fingers 145 on each lower wall portion 117A, 119A will be pushed laterally apart in order to allow the lower journals 125A to move downwardly, past the restricted openings 143, and the fingers 145 may also be slightly bent temporarily by such downward movement of the lower journals but without permanent bend lines forming in the lower wall portions. This will disconnect the lower drive wheel 109, together with the operating cord 111, from the upper drive wheel (not shown) and from the rest of the control system 101. However under normal operating conditions, the lower journals 125A will be held in the circular portions 139 of the lower bearings 124A of the lower housing portion 115. Indeed, the two fingers 145 will not move apart and allow the lower journals 125A to move downwardly past the restricted openings 143 in the lower bearings 124A unless the downward force on both the first and second cord portions 131, 133 exceeds a predetermined value, such as would be produced if a child became entangled in the loop of the operating cord 111.

The lower drive wheel 109, with the operating cord 111, can be pushed back into the housing 103 and operatively reconnected to the upper drive wheel (not shown) and the rest of the control system 101. This can be done simply by pushing the lower drive wheel 109 with the operating cord upwardly into the lower housing portion 115, past the two fingers 145 and the restricted openings 143, so that its lower journals 125A are again in the circular portions 139 of the lower bearings 124A.

Figure 4:
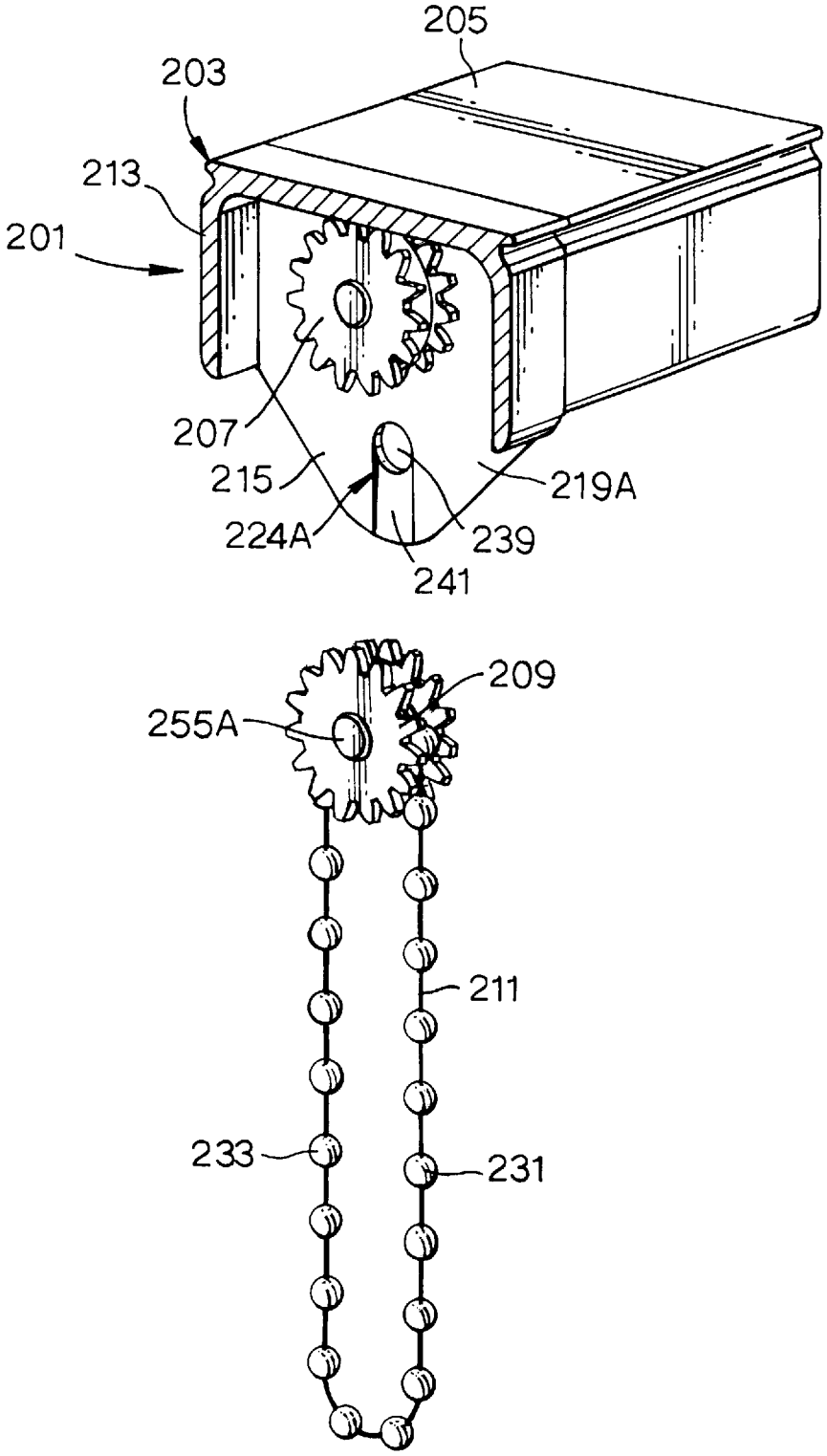
FIG. 4 is a perspective view, similar to FIG. 1, of a third embodiment of the control system of this invention in its housing (partially cut-away along a laterally-extending plane) on a head rail of a venetian blind; a lower drive wheel of the control system, with an operating cord looped about it, has been disconnected from the rest of the system.

FIG. 4 shows a third embodiment 201 of a control system of this invention which is similar to the control system 101 of FIG. 3 and for which corresponding reference numerals (greater by 100) are used below for describing the same or corresponding parts.

The control system 201 is in a housing 203, mounted as an end cap on a head rail 205 of a venetian blind (not shown). The control system 201 includes: an upper drive wheel 207, rotatably mounted in an upper portion 213 of the housing 203 and operatively connected to a driven member (not shown); a lower drive wheel 209, rotatably connected to a lower portion 215 of the housing 203 and operatively connected to the upper drive wheel; and an endless-loop, operating cord 211, looped over the lower drive wheel.

The inner surfaces of the left and right, lower wall portions 217A (not shown), 219A of the lower housing portion 215 each have a longitudinally-extending lower bearing 224A that is complementary to a corresponding longitudinally-extending lower journal 225A, located at the center of the each side of the lower drive wheel 209. Each lower bearing 224A is formed as a blind recess with a longitudinally-extending, upper, generally circular hole 239 and a downwardly-extending stem portion or groove 241, connected to the circular hole. The circular hole 239 of each lower bearing 224A is deeper than its stem portion 241, in that its circular hole 239 extends longitudinally farther from the inner surface of its lower wall portion 217A (not shown), 219A than does its stem portion 241. Preferably the lower journals 225A or the lower bearings 224A, especially both, have beveled edges.

The portions of the circular holes 239 of the lower bearings 224A, extending longitudinally further and thus deeper than the stem portions 241 of the lower bearings, are adapted to accommodate and hold the lower journals 225A of the lower drive wheel 209 in the housing 203 during normal operation of the control system 201. When excessive downward force is exerted simultaneously on both depending portions 231, 233 of the operating cord 211, the beveled edges of the lower journals 225A bear down on the beveled edges of the circular holes 239 of the lower bearings 224A. This causes the flexible, lower, left and right, wall portions 217A (not shown), 219A of the housing 203 to be pushed longitudinally apart from each other and possibly the lower wall portions also to be slightly bent temporarily but without permanent bend lines forming in the lower wall portions. As a result, the lower journals 225A of the lower drive wheel 209 are dislodged from the circular holes 239 of the lower bearings 224A and then pulled downwardly in their stem portions 241 until the lower journals are pulled downwardly out of the bottom of the housing 103. This will disconnect the lower drive wheel 209, together with the operating cord 211, from the upper drive wheel 207 and from the rest of the control system 201.

The lower drive wheel 209, with the operating cord 211, can be pushed back into the housing 203 and operatively reconnected to the upper drive wheel 207 and the rest of the control system 201. This can be done simply by pushing the lower drive wheel 209 with the operating cord upwardly into the lower housing portion 215, along the stem portions 241 of the lower bearings 224A, so that its lower journals 225A are again in the circular portions 239 of the lower bearings.

Figure 6:
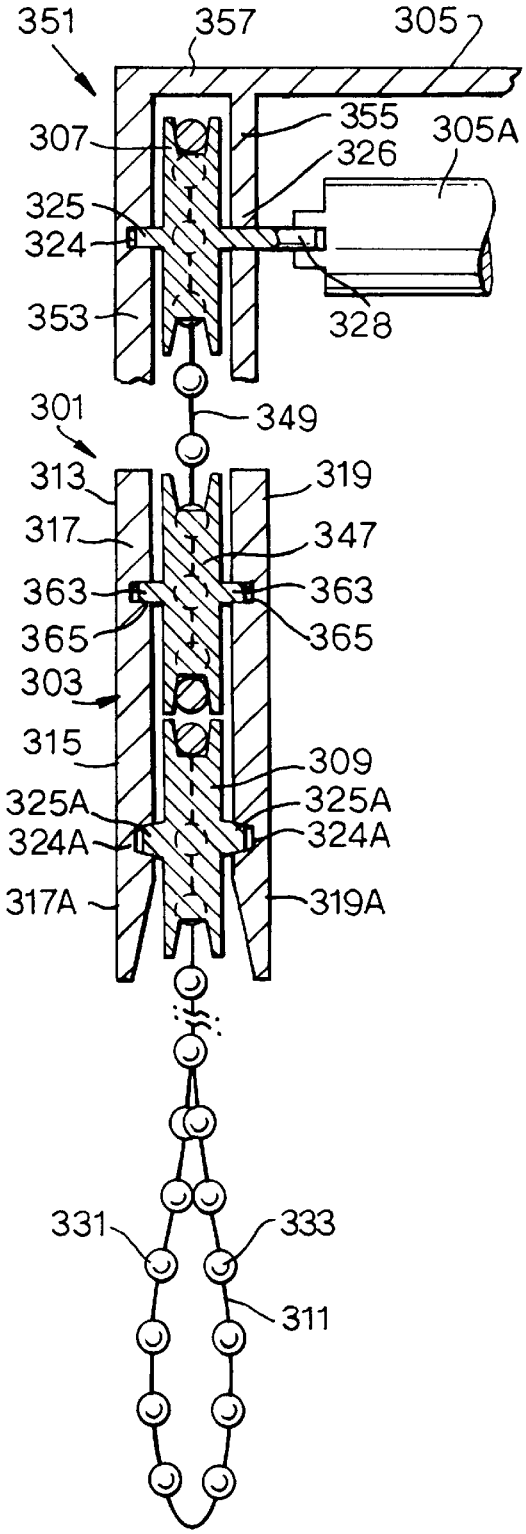
FIG. 6 is a sectional view of the fourth embodiment of the control system, taken along a longitudinally-extending plane through its housing and its auxiliary housing as shown in FIG. 5; the lower drive wheel, operating cord, auxiliary drive wheel, auxiliary operating cord and upper drive wheel are not in section.
Figure 5:
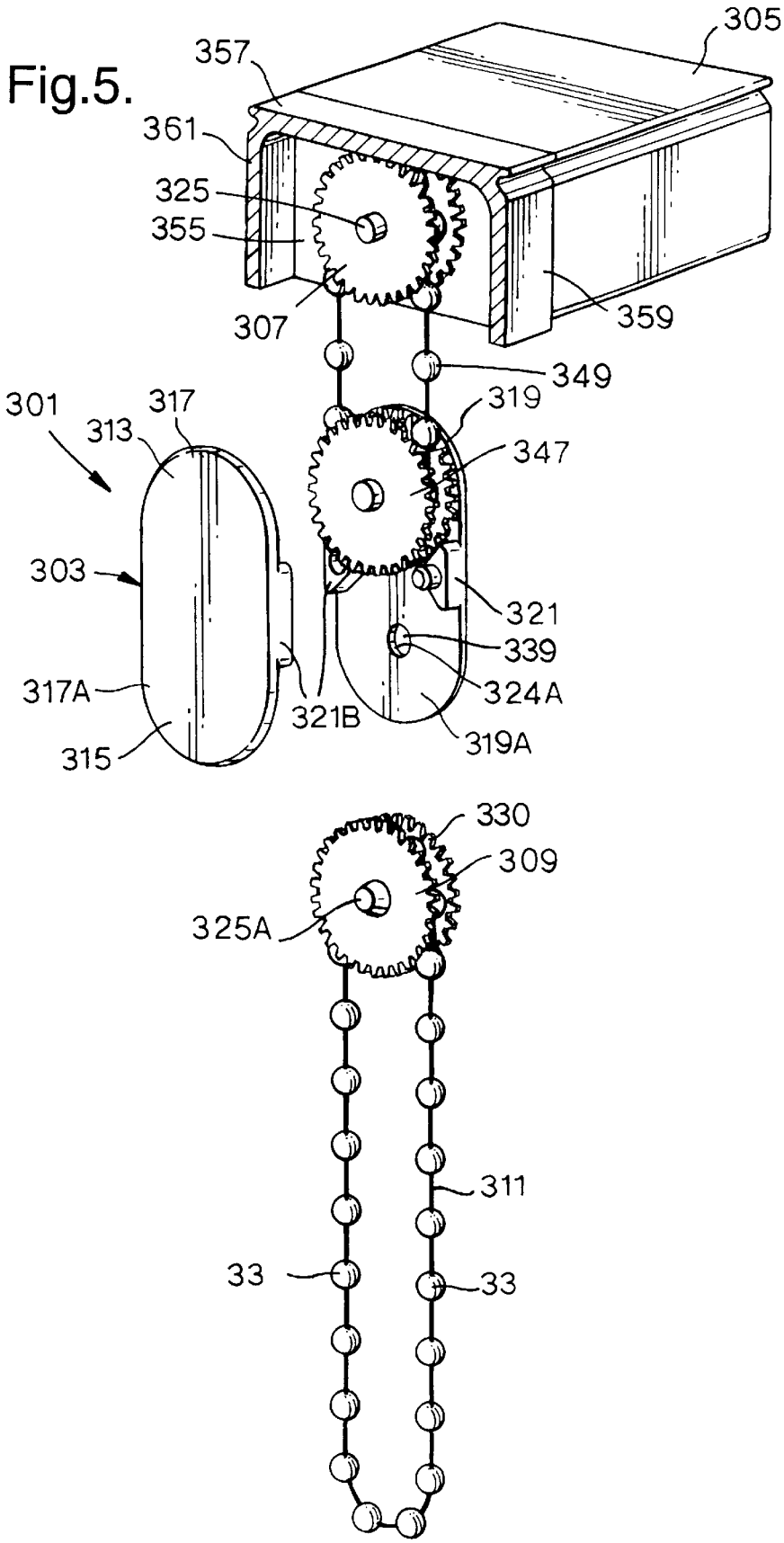
FIG. 5 is a perspective view of a fourth embodiment of the control system of this invention in its housing (exploded) and in its auxiliary housing (partially cut-away along a laterally-extending plane) on a head rail of a venetian blind; a lower drive wheel in the housing, with an operating cord looped about it, is engaged with an intermediate drive wheel in the housing, and the intermediate drive wheel has an auxiliary operating cord looped about it and about an upper drive wheel in the auxiliary housing, so that the lower drive wheel engages the rest of the system.

FIGS. 5 and 6 show a fourth embodiment 301 of the control system of this invention which is similar to the control system of 201 of FIG. 4 and for which corresponding reference numerals (greater by 100) are used for describing the same or corresponding parts.

The control system 301 features a third or intermediate drive wheel 347 and a second or auxiliary drive cord 349. The housing 303, which is the main housing of the control system 301, holds a rotatable lower drive wheel 309 and the rotatable intermediate drive wheel 347. A rotatable upper drive wheel 307 is provided in a fixed auxiliary housing 351 connected to a head rail 305 of a venetian blind.

As shown in FIG. 6, the auxiliary housing 351 has an upstanding, laterally-extending, left wall 353, remote from the head rail 305, and an opposite upstanding laterally-extending, right wall 355, adjacent to or integral with the head rail. The left and right walls 353, 355 of the auxiliary housing are connected by a horizontally-extending top wall member 357, atop the left and right walls, and by a pair of upstanding front and back, side bridging wall members 359, 361 at the lateral sides of the left and right walls. The upper drive wheel 307 has left and right, upper journals 325 and 328 that protrude from its opposite lateral side and are rotatably carried in, respectively, a left upper bearing 324 in the left wall 353 of the auxiliary housing 351 and a right upper bearing 328 in the right wall 355 of the auxiliary housing.

The main housing 303, carrying the lower drive wheel 309, is attached to the upper drive wheel 307 by an endless-loop auxiliary drive cord 349 that is looped about and engages the circumference of both the intermediate drive wheel 347 and the upper drive wheel 307. The housing 303 can thus be easily retrofitted to an existing blind with an upper drive wheel 307. The main housing 303 has an upper portion 313, in which the intermediate drive wheel 347 is mounted, and a lower portion 315, in which the lower drive wheel 309 is mounted. The lower drive wheel 309 is operatively connected to the upper drive wheel 307 by means of the intermediate drive wheel 347 and the auxiliary drive cord 349, so that rotation of the lower drive wheel 309 causes rotation of the intermediate drive wheel, which in turn causes rotation of the upper drive wheel. The lower drive wheel 309 can be rotated by pulling either one of the depending portions 331, 333 of the main drive cord 311 that is looped over it.

As also shown in FIG. 6, the upper portion 313 of the housing 303 includes a pair of opposite, upstanding, laterally-extending, left and right, upper wall portions 317, 319, and similarly, the lower portion 315 of the housing 303 includes a pair of opposite, upstanding, laterally-extending, left and right, lower wall portions 317A, 319A. Preferably, the upper and lower, wall portions are integral with each other, the lower wall portions 317A 319A extending downward from the upper wall portions 317, 319 and the lower end of the upper wall portions contacting the upper end of the lower wall portions. The opposite wall portions 317, 319, 317A, 319A are connected by a pair of upstanding, front and back, bridging wall members 321A, 321B. The side bridging wall members extend longitudinally between the opposite wall portions. As shown in FIG. 5, the side bridging wall members can be relatively short, leaving unconnected large portions of the front and back of the upper and lower housing portions 313, 315.

The inner surfaces of the lower wall portions 317A (not shown), 319A of the main housing 303 each have a longitudinally-extending lower bearing 324A that is complementary to, and carries, a corresponding longitudinally-extending lower journal 325A protruding from left and right sides of the lower drive wheel 309. Each lower bearing 324A is formed as a circular blind hole 339. Preferably, the lower journals 325A or the lower bearings 324A, or both have beveled edges. The blind holes 339 of the lower bearings 324A are adapted to accommodate and hold the lower journals 325A of the lower drive wheel 309 in the lower portion 315 of the housing 303 during normal operation of the control system 301.

Protruding from left and right sides of the intermediate drive wheel 347 are longitudinally-extending intermediate journals 363 that are complementary to, and carried by, longitudinally-extending intermediate bearings 365 in the inner surfaces of the upper wall portions 317, 319 of the main housing 303. The intermediate bearings 365 are adapted to accommodate and hold the intermediate journals 325A of the intermediate drive wheel 347 in the upper portion 313 of the housing 303.

When excessive downward force is exerted simultaneously on both depending portions 331, 333 of the operating cord 311, the beveled edges of the lower journals 325A bear down on the preferably also beveled edges of the circular holes 339 of the lower bearings 324A. This causes the flexible, left and right, lower wall portions 317A (not shown), 319A of the lower portion 315 of the housing 303 to be pushed longitudinally apart from each other and possibly to slightly bend temporarily the lower wall portions but without permanent bend lines being formed in the lower wall portions. As a result, the lower journals 325A of the lower drive wheel 309 are dislodged from the blind holes 339 of the lower bearing 324A and then pulled downwardly out of the bottom of the housing 303. This disconnects the lower drive wheel 309, together with the operating cord 311, from the intermediate drive wheel 347 and thus from the rest of the control system 301.

Figure 7:
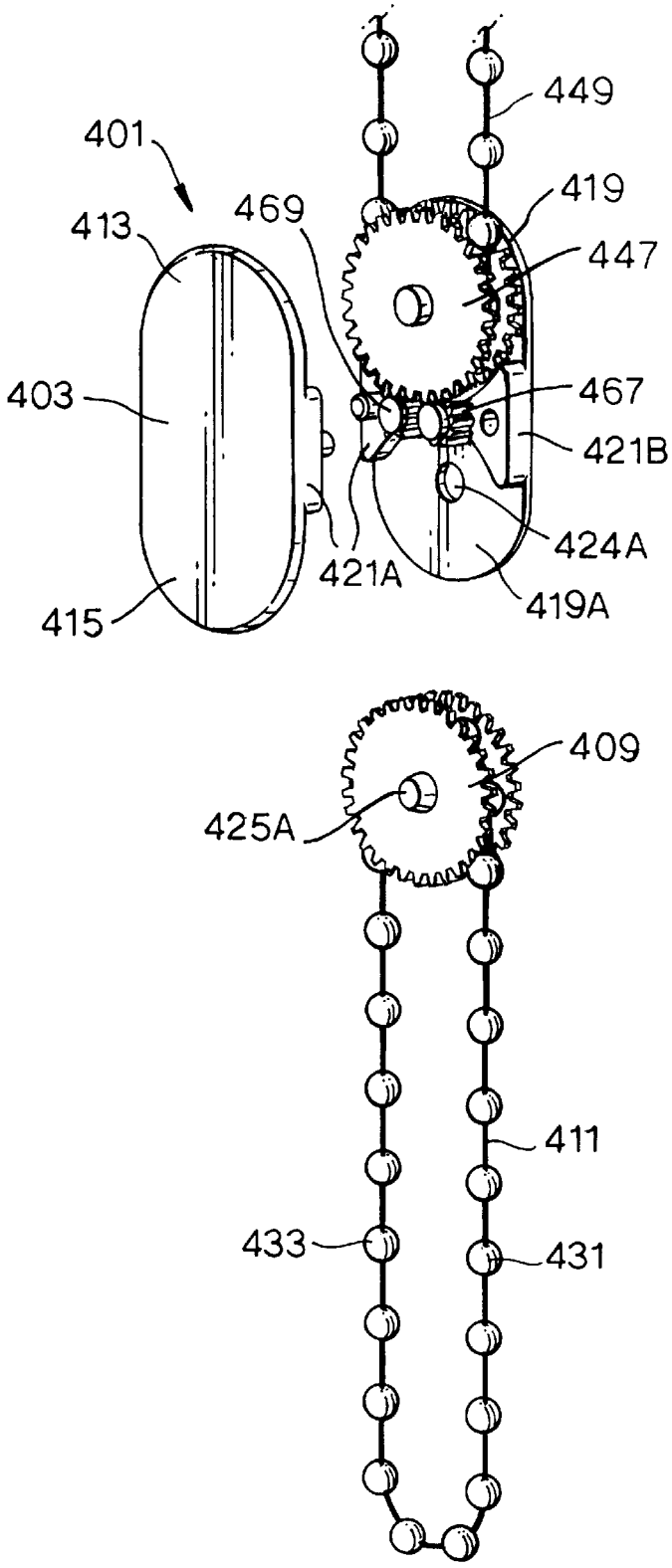
FIG. 7 is a perspective view of a portion of a fifth embodiment of a control system of this invention that is very similar to the control system of FIGS. 5 and 6; a lower drive wheel in its housing (exploded), with an operating cord looped about it, engages an intermediate drive wheel in the housing, and the intermediate drive wheel has an auxiliary operating cord looped about it and about an upper drive wheel in its auxiliary housing, so that the lower drive wheel engages the upper drive wheel.

FIG. 7 shows a fifth embodiment 401 of a control system of this invention which is similar to the control system of 301 of FIGS. 5 and 6 and for which corresponding reference numerals (greater by 100) are used for describing the same or corresponding parts.

The control system 401 includes a main housing 403 with an intermediate drive wheel 447, a detachable lower drive wheel 409, and an auxiliary drive cord 449. An upper drive wheel (not shown), connected to a driven member (not shown) in the head rail of a venetian blind, is located in an auxiliary housing (not shown) mounted as an end cap on the head rail, above the housing 403. The auxiliary drive cord 449 is looped about the intermediate drive wheel 447 and the upper drive wheel, and an operating cord 411 is looped about the lower drive wheel 409.

In the systems of FIGS. 1–6, the direction of rotation of the lower drive wheel and the direction of rotation of the upper drive wheel are opposite. This change in the direction of rotation can cause some confusion or irritation for the user of a venetian blind. In order to avoid this inconvenience, a pair of small parallel intermediate pinion wheels 467, 469 are mounted in the housing 403 between the lower drive wheel 409 and the intermediate drive wheel 447. The pinion wheels 467, 469 operatively connect the lower drive wheel to the intermediate drive wheel, so that when either of the depending portions 431 or 433 of the operating cord 411 is pulled downwardly, the upper drive wheel 407 (not shown) will rotate in the same direction as the lower drive wheel. However, when excessive downward force is exerted simultaneously on both depending cord portions 431, 433, beveled edges of the lower journals 425A of the lower drive wheel 409 bear down on beveled edges of the lower bearings 424A in inner surfaces of lower wall portions 417A (not shown), 419A of the housing 403, so that the lower journals are dislodged from the lower bearings and the lower drive wheel is pulled downwardly out of the bottom of the housing 403 to disconnect the lower drive wheel, together with the operating cord 411, from the intermediate drive wheel 447 and thus from the rest of the control system 401.

Preferably, the bridging wall members 421A, 421B of the housing 403 are provided with an inwardly facing contour which allows the pinion wheels 467, 469 to be mounted within the housing 403. The height of the housing 403 is preferably somewhat greater than that of the corresponding housing 303 of the control system 301 of FIGS. 5 and 6 in order to accommodate the pinion wheels.

Figure 8:
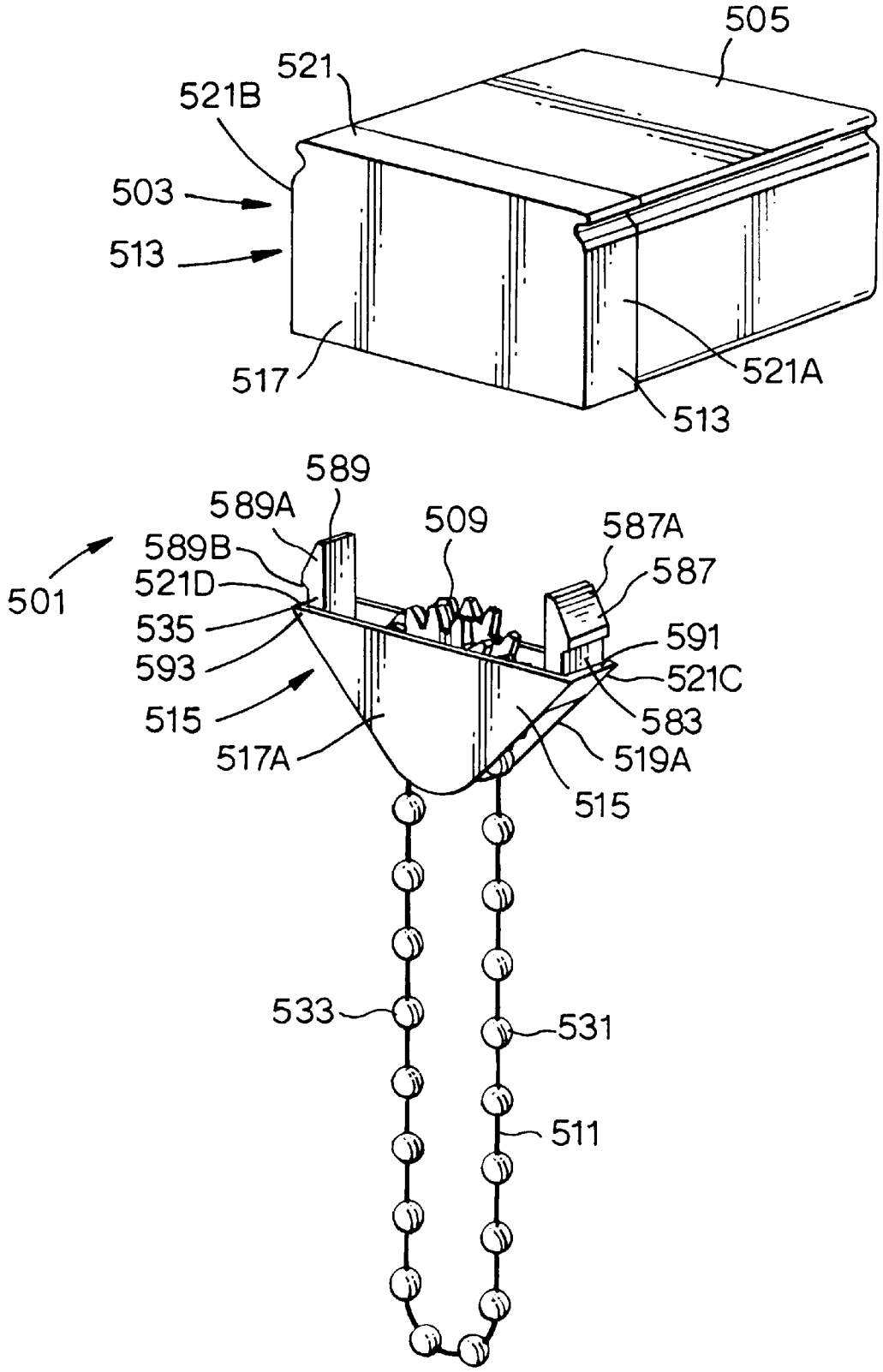
FIG. 8 is a perspective view, of a sixth embodiment of the control system of this invention in its housing on a head rail of a venetian blind, with a lower portion of the housing disconnected from an upper portion.
Figure 9:
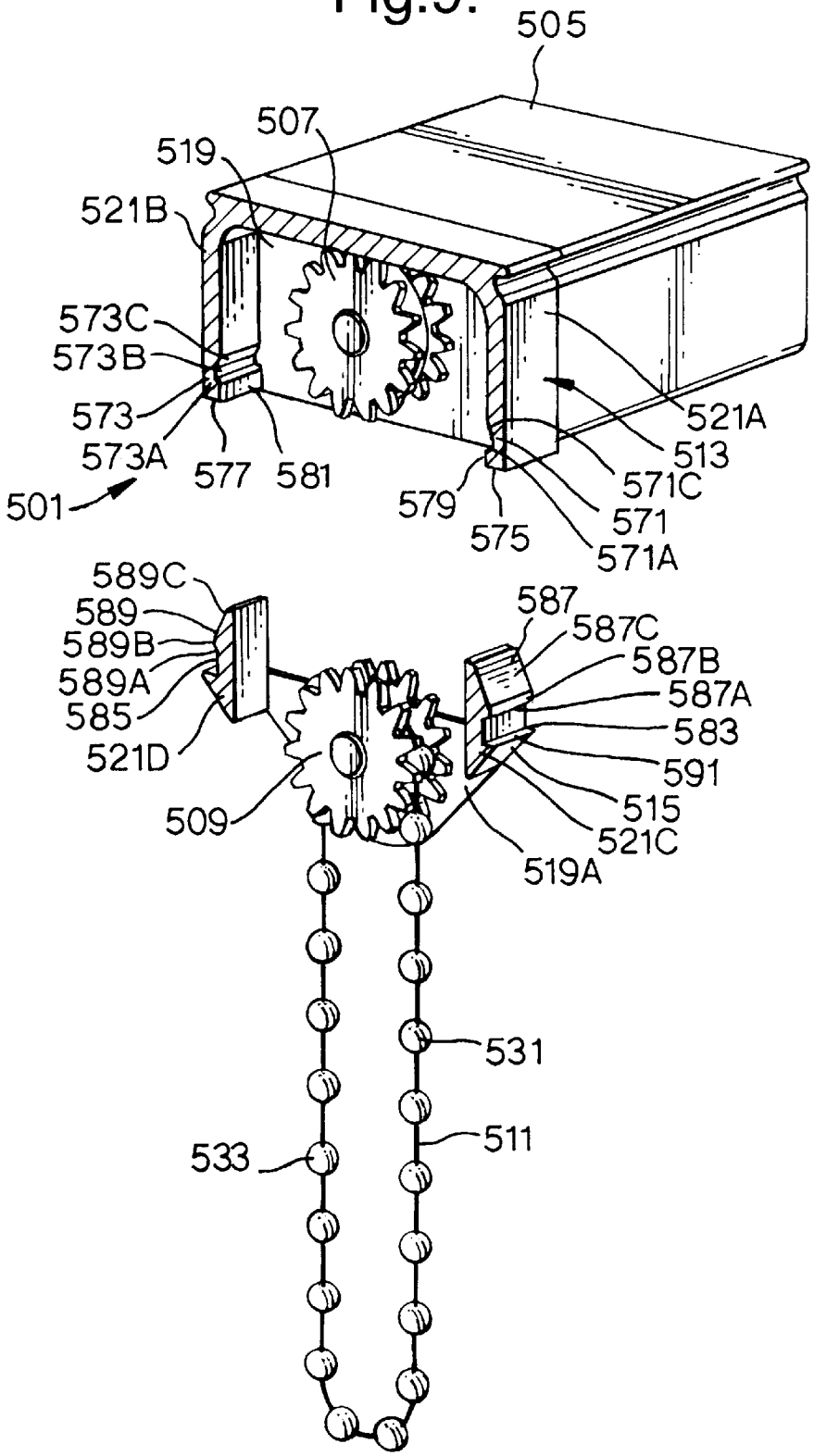
FIG. 9 is a perspective view, similar to FIG. 8, of the sixth embodiment of the control system with the lower and upper portions of its housing (partially cut-away along a laterally-extending plane) disconnected.
Figure 10:
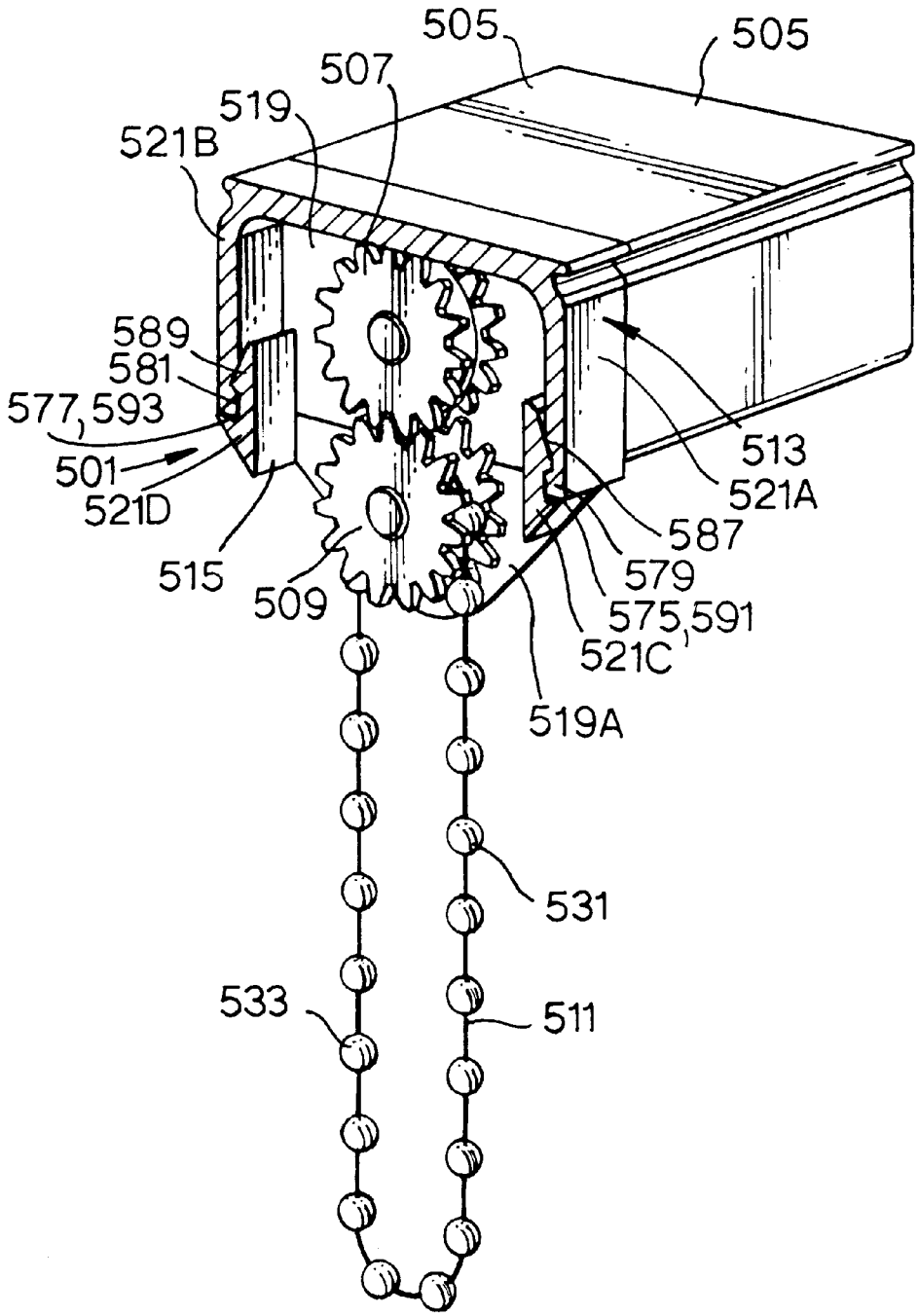
FIG. 10 is a perspective view, similar to FIGS. 8 and 9, of the sixth embodiment of the control system with the lower and upper portions of its housing (partially cut-away along a laterally-extending plane) connected.

FIGS. 8–10 shows a sixth embodiment 501 of the control system of this invention which is similar to the control system 101 of FIG. 1 and for which corresponding reference numerals (greater by 500) are used for describing the same or corresponding parts.

Upper and lower drive wheels 507, 509 are rotatably mounted in upper and lower portions 513, 515 of housing 503 and are operatively engaged to each other. The upper housing portion 513 is attached to blind head rail 505, and the lower housing portion 515 is releasably attached to the upper housing portion, preferably by a releasable snap engagement, as described below.

As seen from FIG. 9, the upper housing portion 513 has upstanding, front and back, bridging wall members 521A, 521B, the inner surfaces of which have front and back slots 571, 573 facing each other. The slots extend longitudinally across the width of the upper bridging wall members and are relatively close to bottom surfaces 575, 577 thereof. Between their bottom surfaces 575, 577 and their slots 571, 573, the inner surfaces of the upper bridging wall members 521A, 521B have upstanding intermediate surfaces portions 579, 581. The slots 571, 573 each have an outwardly-extending, slightly sloped ledge 571A, 573A, above which is preferably an upstanding intermediate portion 571B, 573B, and above which is an inwardly-extending gentle ramp 571C, 573C.

As also seen from FIG. 9, the lower housing portion 515 has upstanding, front and back, bridging wall members 521C, 521D. On top surfaces 591, 593 of the lower bridging wall members 521C and 521D are cantilever beams 583, 585 which extend upwardly and longitudinally. At the top of each cantilever beam is a snap-lug 587, 589. The cantilever beams 583, 585 can flex laterally inwardly, towards each other, when the upper and lower housing portions 513, 515 are urged vertically together to attach them to each other as shown in FIG. 10. The cantilever beams 583, 585 are also resilient and can flex back laterally outwardly, away from each other, when the snap-lugs 587, 589 snap into the slots 571, 573 of the upper bridging wall members 521A, 521B of the upper housing portion 513. The snap-lugs 587, 589 have a generally triangular shape and extend laterally outwardly away from each other. Preferably, each snap-lug has a gentle entrance ramp 587C, 589C at its top or entrance side, a sharper angled retraction ramp 587A,589A at its bottom or retraction side, and preferably an upstanding intermediate portion 587B, 589B between them. When the two housing portions 513, 515 are pushed vertically together to attach them to each other, the entrance ramps 587C, 589C of the snap-lugs 587, 589 on the lower, front and back, bridging wall members 521C, 521D are urged against the bottom surfaces 575, 577 of the upper, front and back, bridging wall members 521A, 521B, thereby forcing the snap-lugs and the cantilever beams 683, 685 laterally towards each other until the snap-lugs reach the slots 571, 573. Then, the snap-lugs and cantilever beams move laterally apart as the snap-lugs move laterally into the slots. In this regard, each intermediate snap-lug portion 587B, 589B is adapted to fit in an intermediate slot portion 571B, 573B in the upper housing portion 513 when the upper and lower housing portions are attached to each other as shown in FIG. 10, but both such intermediate slot portions and snap-lug portions can be dispensed with if the snap-lugs 587, 589 are sharp, rather than truncated as shown in FIGS. 8–10.

Preferably, the bottom surfaces 575, 577 of the bridging wall members 521A, 521B of the upper housing portion 513 contact the top surfaces 591, 593 of the bridging wall members 521C and 521D of the lower housing 515 when the two housing portions are attached to each other. The upper housing bottom surfaces 575, 577 and the lower housing top surfaces 591, 593 are preferably horizontally-extending surfaces, and the cantilever beams 583, 585 preferably are located directly laterally inward from these surfaces, so that the upstanding laterally-outward portions of the cantilever beams, between the snap-lugs 587, 589 and the ledges 591, 593, contact the intermediate inner surface portions 579, 581 of the upper bridging wall members 521A, 521B when the two housing portions are attached to each other.

After the snap-lugs 587, 589 atop the cantilever beams 583, 585 of the lower housing portion 515 have been snapped into the slots 571, 573 near the bottom of the bridging wall members 521A, 521B of the upper housing portion 513 , the upper and lower housing portions are securely attached to each other, and the upper and lower drive wheels 507, 509 are operatively engaged.

During normal use of the operating cord 511 of the control system 501, the snap-lugs 587, 589 stay in engagement with the slots 571, 573. However if an excessive downward force is exerted simultaneously on both depending portions 531, 533 of the operating cord 511, the lower housing portion 515 will be pulled downwardly, causing the retraction ramps 587A, 589A on its snap-lugs 587, 589 to be urged inwardly, towards each other, by the sloped ledges 571A, 573A at the bottom of the slots 571, 573 in the inner surfaces of the upper bridging wall members 521A, 521B, in turn causing the cantilever beams 583, 585 to be flexed slightly inwardly, towards each other. The angled snap-lug ramps 587A, 589A will then slide downwardly, along the sloped slot ledges 571A, 573A until the snap-lugs are completely out of the slots 571, 573. Thereby, the lower housing portion 515 will be detached from the upper housing portion 513, and the lower drive wheel 509 will be disengaged from the upper drive wheel 507. In this regard, the combination of the flexibility of the cantilever beams 583, 585 and the angles of the snap-lug entrance ramps 587A, 589A and the complementary sloped slot ledges 571A, 573A ensure the detachment of the upper and lower housing portions, when needed.

If desired, the rotatable lower drive wheel 509 can be releasably mounted in the lower housing portion 515 as described above for the lower drive wheels 9, 109 and 209 of control systems 1, 101, and 201 shown in FIGS. 1–4. This would provide a double safety feature because if would assure that if, for whatever reason, the lower housing portion 515 is not detached from the upper housing portion 513 when both depending portions 531, 533 of the operating cord 511 are pulled simultaneously with excessive force, the lower drive wheel 509 will still be pulled from the housing 503.

Figure 11:
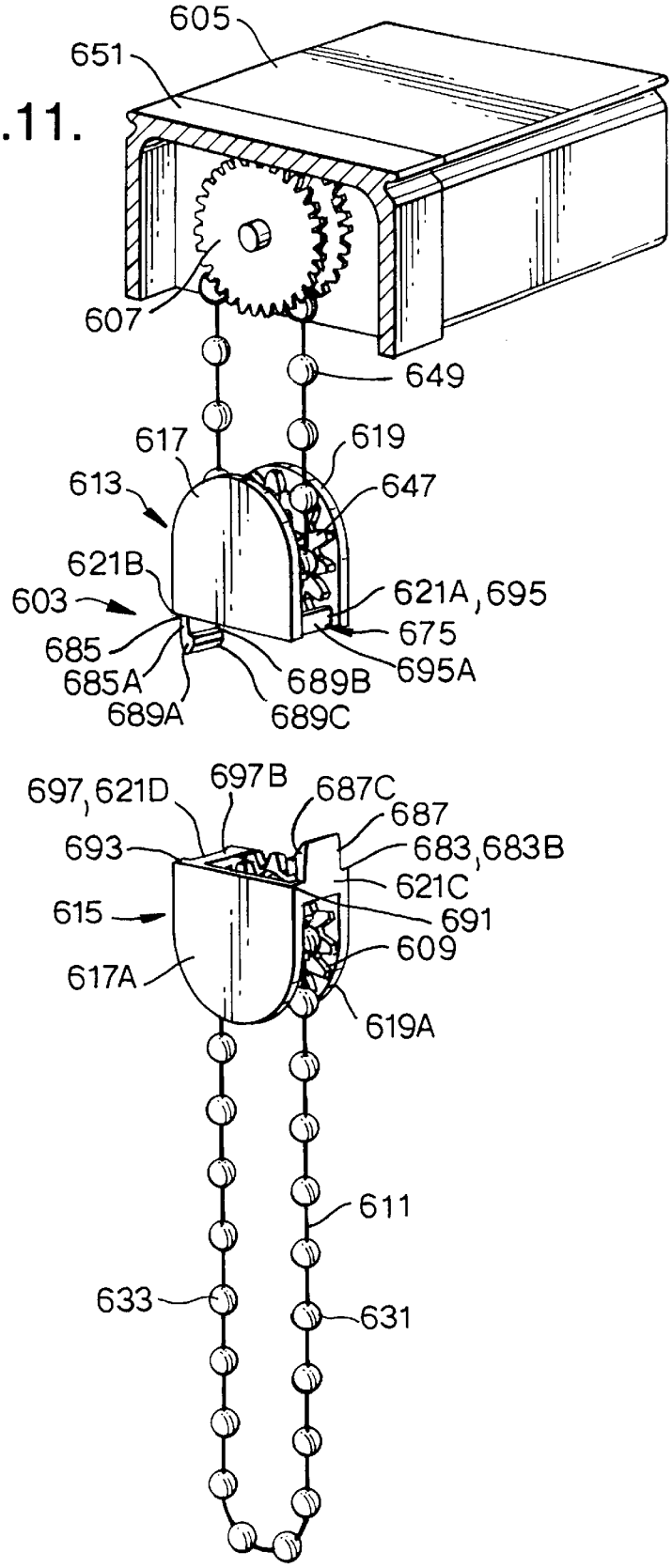
FIG. 11 is a perspective view of a seventh embodiment of the control system of this invention in its housing and in its auxiliary housing (partially cut-away along a laterally-extending plane) on a head rail of a venetian blind, with a lower portion of the housing disconnected from an upper portion.
Figure 12:
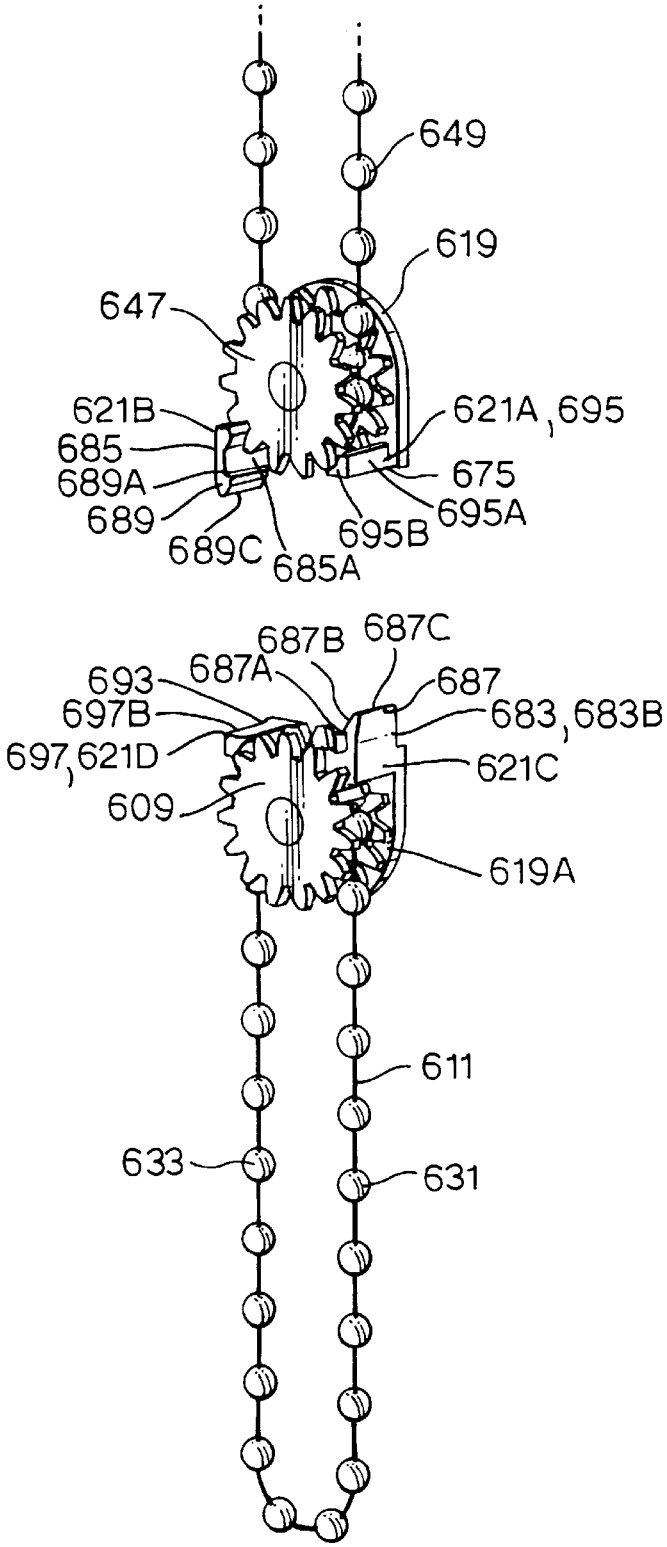
FIG. 12 is a perspective view, similar to FIG. 11, of the seventh embodiment of the control system with the lower and upper portions of its housing (partially cut-away along a laterally-extending plane) disconnected.

FIGS. 11–12 show a seventh embodiment 601 of the control system of this invention which is similar to the control system of 501 of FIGS. 8–10 and for which corresponding reference numerals (greater by 100) are used for describing the same or corresponding parts.

The control system 601 features detachable upper and lower portions 613, 615 of a housing 603. On a top surface 691 of a front bridging wall member 621C of the lower housing portion 615 and on a bottom surface 677 of a back bridging wall member 621B of the upper housing portion 613 are front and back, laterally flexible but resilient, cantilever beams 683, 685, respectively. The cantilever beams extend vertically towards each other and, at their vertical extremities, have front and back snap-lugs 687, 689. The laterally outer surface 683B, 685B of each cantilever beam 683, 685 is coplanar with the outer surface of its bridging wall member 621C, 621B, respectively. The snap-lugs 687, 689 are generally triangular in shape and extend laterally inwardly, towards each other. Each snap-lug preferably has a gentle entrance ramp 687C, 689C at its vertical extremity or entrance side, a sharper angled retraction ramp 687A (not shown), 689A adjacent its beam or at its retraction side, and vertically-extending intermediate portion 687B, 689B between them.

The upper front and lower back, side bridging wall members 621A, 621D are in the shape of longitudinally-extending beam-like snap-lug retainers 695, 697. The snap-lug retainers 695, 697 are located slightly inwardly of the laterally outer edges of the left and right walls 617, 617A, 619, 619A of the housing 603. The retainers 695, 697 preferably have generally triangular shape with: i) a vertically-extending, laterally outer wall 695A, 697A that is slightly inwardly of the laterally outer edges of the left and right walls 617, 617A, ii) a horizontally-extending end wall 695B, 697B that forms a top surface 693 on the back lower bridging wall member 621D or a bottom surface 675 of the front upper bridging wall member 621A, and iii) a laterally- and inwardly-extending connecting wall 695C, 697C.

The snap-lugs 687, 689 on the cantilever beams 683, 685 are adapted for snap-fit engagement with the snap-lug retainers 695, 697 to attach the two housing portions 613, 615 together. In this regard, the vertical distance between each snap-lug 687, 689 and the top surface 691 on the lower front bridging wall member 621C or the bottom surface 675 of the upper back bridging wall member 621B, respectively, is no more than the height of the vertically-extending outer wall 695A, 697A of one of the snap-lug retainers 695, 697, respectively. Thereby, when the two housing portions 613, 615 are pushed vertically together, the entrance ramps 687C, 689C of the snap-lugs 687, 689 are urged against the end walls 695B, 697B of the retainers 695, 697, thereby forcing the snap-lugs and the cantilever beams 683, 685 laterally apart until the snap-lugs and the cantilever beams 683, 685 pass the retainers. Then, the snap-lugs can engage their adjacent retainers with the laterally-inner surface 683A, 685A of their cantilever beams 683, 685 laterally adjacent the outer wall 695A, 697A of their adjacent retainers.

With the upper and lower housing portions 613, 615 attached to each other, the intermediate and lower drive wheels 647, 609 are operatively engaged, and during normal operation of the control system 601 and its operating cord 611, the snap-lugs 687, 689 are held in engagement with the snap-lug retainers 695, 697. If the first and second cord portions 631, 633 are pulled downwardly simultaneously by an excessive force, the snap-lugs are pulled out of engagement with the retainers, and the lower housing portion is detached from the upper housing portion. In this process, the cantilever beams 683, 685 will flex slightly laterally outward as a result of the force on the retraction ramps 687A, 689A of the snap-lugs, exerted by the end walls 695B, 697B of the retainers. The snap-lugs 687, 689 will then be disconnected from the retainers 695, 697.

Preferably, the lower drive wheel 609 is releasably mounted in the lower housing portion 615 to provide an extra safety feature.

Figure 13:
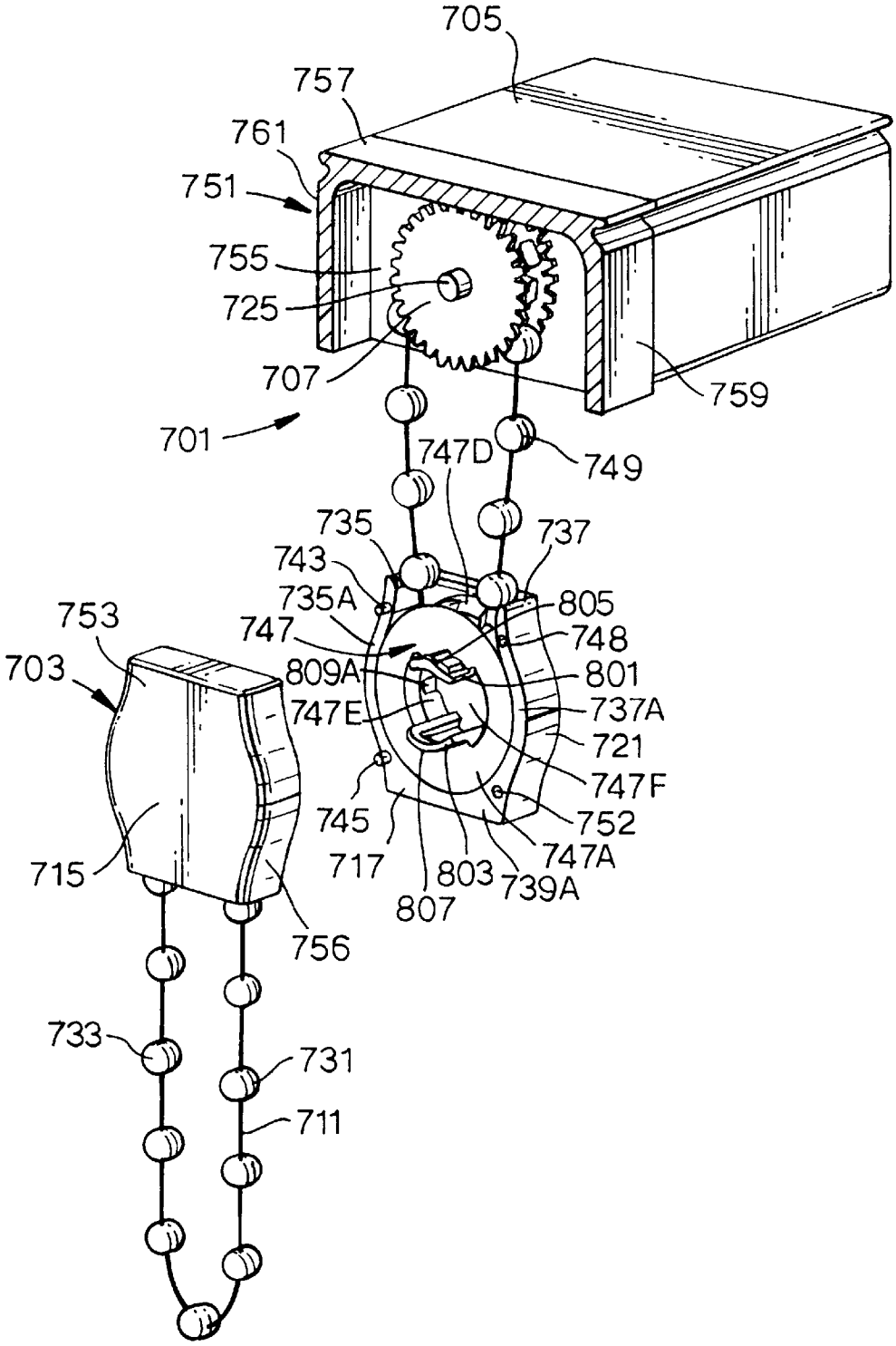
FIG. 13 is a perspective view of an eighth embodiment of the control system of this invention in its housing (exploded) and in its auxiliary housing (partially cut-away along a laterally-extending plane) on a head rail of a venetian blind; a left drive wheel in a left portion of its housing, with an operating cord looped about it, engages a right intermediate drive wheel in a right portion of the housing, and the right drive wheel has an auxiliary operating cord looped about it and about an upper drive wheel in its auxiliary housing, so that the left drive wheel engages the upper drive wheel.
Figure 14:
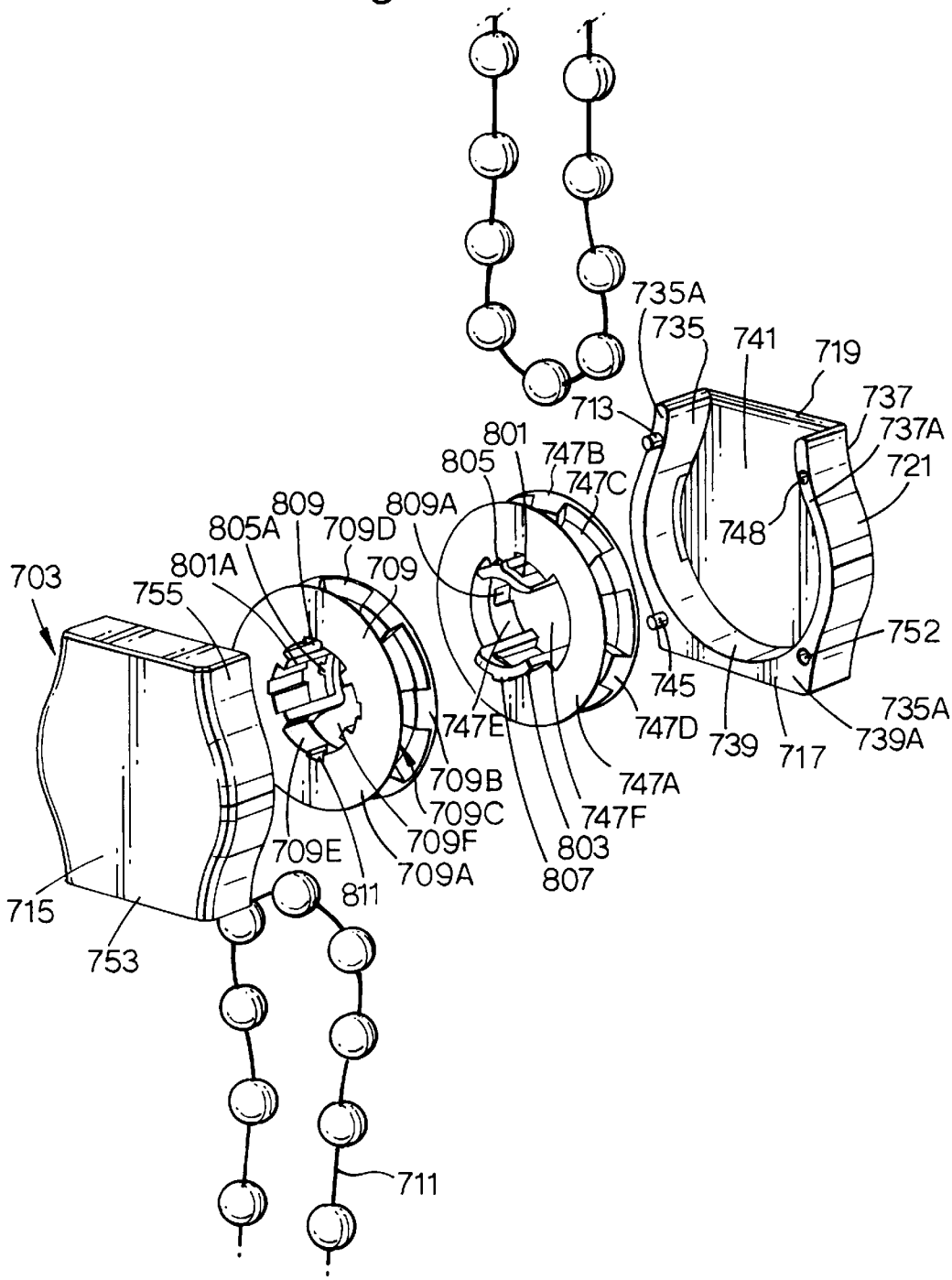
FIG. 14 is a perspective view, similar to FIG. 13, of the eighth embodiment of the control system with the left and right, drive wheels disconnected in the housing (exploded).

FIGS. 13–14 show an eighth embodiment 701 of the control system of this invention which is similar to the control system of 301 of FIGS. 5–6 and for which corresponding reference numerals (greater by 400) are used for describing the same or corresponding parts.

The control system 701 has a housing 703, which is the main housing of the control system and holds a rotatable lower drive wheel 709 and a rotatable intermediate drive wheel 747. A rotatable upper drive wheel 707 is provided in a fixed auxiliary housing 751 (partly shown) connected to a head rail 705 of a venetian blind. An auxiliary operating cord 749 is looped about and connects the upper and intermediate drive wheels, and a main operating cord 711 is looped over the lower drive wheel 709.

The intermediate drive wheel 747 and the lower drive wheel 709 are coaxially and releasably, preferably snap-fit, connected to each other in the main housing 703. The intermediate drive wheel 747 has a circular left wall 747A and right wall 747B (not visible) that are spaced apart but connected by a coaxial cylindrical bridging member 747C. The bridging member 747C has an outer circumferential grooved surface 747D for accommodating the auxiliary operating cord 749, and an inner annular surface 747E surrounding a central axial opening 747F. Likewise, the lower drive wheel 709 has a circular left wall 709A and right wall 709B, a cylindrical bridging member 709C, with an outer circumferential grooved surface 709D for accommodating the operating cord 711 and an inner annular surface 709E surrounding a central axial opening 709F. The left wall 747A of the intermediate drive wheel 747 is coaxially and releasably, preferably snap-fit, connected to the right wall 709B of the lower drive wheel 709.

The snap fit connection, generally 800, of the intermediate and lower drive wheel 747, 709 includes a pair of cantilever beams 801, 803, mounted on the inner annular surface 747E of the intermediate drive wheel and extending longitudinally to the left of its left wall 747A and towards the central axial opening 709F of the lower drive wheel. For each beam 801, 803 on the intermediate drive wheel 747, there is a complementary slot 809, 811 extending longitudinally in the inner annular surface 709E of the lower drive wheel between its left and right walls 709A, 709B. The beams 801, 803 are preferably on diametrically opposite sides of the inner annular surface 747E of the intermediate drive wheel, and the slots 809, 811 are preferably on diametrically opposite sides of the inner annular surface 709E of the lower drive wheel.

Each beam 801, 803 is generally C-shaped, the closed end of the C-shape extending outwardly of the inner annular surface 709E of the lower drive wheel 709 and including a projecting snap-lug 805, 807 on its radially outward surface. Each beam is flexible but resilient, so that when the intermediate and lower drive wheels 747, 709 are pushed axially together to connect them coaxially, the beams can flex somewhat radially inwardly of the inner annular surface 747E of the intermediate drive wheel and will then flex back radially outward when the snap-lugs 805, 807 snap into one of the complementary slots 809, 811 of the inner annular surface 709E of the lower drive wheel. The snap-lugs 805, 807 extend radially outwardly of the closed end of the C-shaped beams and are to the left of the left wall 747A of the intermediate wheel 747. Each snap-lug has an entrance ramp 805A, 807A (not shown) at its left or entrance side which slopes gently to the right and radially towards the inner annular surface 747E of the intermediate wheel 747. At the right end of each entrance ramp 805A, 807A is a retraction ramp 805B, 807B (not shown) which slopes more sharply to the right and radially away from the inner annular surface 747E of the intermediate wheel. The right end of each retraction ramp 805B, 807B is adjacent the left wall 747A of the intermediate wheel 747. The front of each snap-lug 805, 807, to the left of its entrance ramp 805A, 807A, can be sharp but is preferably truncated as shown in FIGS. 13 and 14.

The beams 801, 803 are adapted to engage the complementary slots 809, 811 in the inner annular surface 709E surrounding the central axial opening 709F of the lower drive wheel 709. Each slot 809, 811 has an entrance surface 809A, 811A (not shown) that is somewhat radially inwardly of the lower drive wheel 709 and extends axially and to the left from its right wall 709B, a carrier surface 809B, 811B (not shown) that is more radially inward of the lower drive wheel 709 and extends axially and to the left from the entrance surface, a locking ledge 809C, 811C (not shown) that extends radially outwardly of the lower drive wheel and to the left from the carrier surface and an end surface 809D, 811D (not shown) that is somewhat radially inwardly of the lower drive wheel 709 and extends axially and to the left to the left wall 709A of the lower drive wheel 709.

When the lower and intermediate drive wheels 709, 747 are being coaxially connected by urging them longitudinally and axially towards each other, the entrance ramps 805A, 807A of the snap-lugs 805, 807 on the beams of the intermediate wheel initially are moved axially along the entrance surfaces 809A, 811A of the slots 809, 811 of the lower drive wheel. The beams 805,807 are thereby flexed somewhat radially inwardly of the lower drive wheel 709 and towards each other. When the entrance ramps 805A, 807A of the snap-lugs have passed the entrance ramps 809A, 811A of the slots, they move axially along the carrier surfaces 809B, 811B and somewhat radially outwardly of the lower drive wheel, away from each other. Thereby, the snap-lugs 805,807 engage the slots 808, 811 with their retraction ramps 805B, 807B to the right of and the locking ledges 809C, 811C of the slots.

Preferably, an additional pair of cantilever beams 801A, 803A (not shown) with radially outwardly-extending snap-lugs 805A, 807A are each mounted on the inner annular surface 709E of the lower drive wheel 709, midway between its slots 809, 811. The additional cantilever beams 801A, 803A are mirror images of the beams 801, 803 with snap lugs 805, 807 of FIGS. 13–14, and each extends longitudinally to the right of the right wall 709B of the lower drive wheel and towards the central axial opening 747F of the intermediate drive wheel 747. It is also preferred that complementary longitudinally-extending slots 809A, 811A are provided in the inner annular surface 747E of the intermediate drive wheel 747, each being midway between its cantilever beams 801, 803. The complementary slots 809A, 811A are mirror images of the slots 809, 811 of FIGS. 13–14, and each extends longitudinally between the left and right walls 747A, 747B of the intermediate drive wheel. The two wheels 709, 747 can thus be doubly snap-fit coaxially together to keep them from rotating relative to one another.

As also shown in FIGS. 13,14, the main housing 703 has a left portion 715, in which is the lower drive wheel 709, and a right portion 717, in which is the intermediate drive wheel 747. The two housing portions are identical but inverse mirror images.

The right housing portion 717 has a right wall 719, on the left side of which is a U-shaped semi-circumferential wall 721 with an open top. The U-shaped wall 721 has a back leg 735, a front leg 737 and a bottom leg 739, and each leg has a left surface 735A, 737A, 739A, respectively. The legs of the U-shaped wall form a semi-circular internal recess 741, in which the intermediate drive wheel 747 is rotatably held with the right surface of its right wall 747B being against the inner surface of the right wall 719 of the right housing portion and with its circumferential grooved surface 747D being closely adjacent to the radially inner surfaces of the U-shaped wall 821. On the left surface 735A of the back leg 735A are upper and lower, guiding pins 743, 745 which extend to the left. On the left surface 737A of the front leg 737 are upper and lower, guiding holes 748, 751 which extend to the left.

The left housing portion 715 has a corresponding left wall 753, on the right side of which is a U-shaped semi-circumferential wall 756 with an open bottom and a semi-circular internal recess (not shown). Guiding pins and holes (not shown), which correspond to the guiding pins 743, 745 and guiding holes 748,752 of the right housing portion 717 but which extend to the right, are provided in the U-shaped wall 756. When the coaxially connected lower and intermediate wheels 709, 747 are located in the semi-circular internal recesses of their respective housing portions 715, 717 and the guiding pins of each housing portion are inserted into the corresponding guiding holes of the other housing portion, housing portions are attached to each other, so that the wheels can suitably rotate in the housing 703. The open top and bottom of the U-shaped walls 721, 756 of the right and left housing portions 717, 715 allow the auxiliary operating cord 749 and the operating cord 711, respectively, to extend vertically out of the housing 703.

The operating cord 711 is looped over the lower drive wheel 709, and in normal operation, pulling either of the depending cord portions 731, 733 will result in rotation of the lower drive wheel. The coaxial connection between the lower and intermediate drive wheels 709, 747 ensures that once the lower drive wheel turns, so will the intermediate drive wheel. Rotation of the intermediate drive wheel 747 results in movement of the auxiliary operating cord 747 which turns the upper drive wheel 707. However, when excessive force is exerted on both depending cord portions 731, 733, their snap-fit connection 800 will become disconnected, and thereby, the lower drive wheel and the operating cord 711 will be disconnected from the system 701.

This invention is, of course, not limited to the above-described embodiments which may be modified without departing from the scope of the invention or sacrificing all of its advantages. In this regard, the terms in the foregoing description and the following claims, such as "longitudinal", "lateral", "inner", "outer", "right", "left", "front", "back", "top", "bottom", "downward", "upper" and "lower", have been used only as relative terms to describe the relationships of the various elements of the control system of the invention for coverings for architectural openings as shown in the Figured. For example, kinematic inversions of the elements of the control systems, described above, are to be considered within the scope of the invention.

For example, the upper drive wheels 7, 107, 207, 507, 607 and the lower drive wheels 9, 109, 209, 509, 609 which are gear wheels that are operatively connected by inter-engaging gear teeth, could be replaced by drive wheels that are operatively connected by friction means. The same goes for the lower drive wheels 307, 407 and the intermediate drive wheels 347, 447. Likewise, the bead chains 11, 111, 211, 311, 411, 511, 611, 711 could be replaced by conventional blind drive cords without beads. Indeed, conventional blind drive wheels, like the lower drive wheels 9, 109, 209, 309, 409, 509, 609, 709, around which the cords or bead chains are looped, have the appropriate shape for functioning with either cords or bead chains. The same goes for the auxiliary operating cords 349, 449, 749.

Moreover, since the control systems 1,101,201 cause a reversal of the rotation direction between their lower drive wheels 9, 109, 209 and upper drive wheels 7,107, 207—which might be confusing for a person using their operating cords 1, 11, 111—additional small intermediate pinion wheels could be mounted in their housings 3, 103, 203. These pinion wheels could operatively connect the lower drive wheels to the upper drive wheels, so that the lower and upper drive wheels turn in the same direction.

Also, in FIGS. 11–12 one cantilever beam 683 extends vertically from the lower housing portion 615 and the other 685 from the upper housing portion 613. However, both beams could extend vertically from either the upper or lower housing portion, towards snap-lug retainers 695, 697 on the other housing portion.

What is claimed is:

1. A cord-operated control system (1, 101, 201, 301, 401, 501, 601, 701) for a covering for an architectural opening, such as a venetian blind, which includes:

a housing (3, 103, 03, 303, 403, 503, 603, 703);

a first drive wheel (7, 107, 207, 307, 407, 507, 607, 707) that is operatively connected to a driven bind member (5A), adapted to rotate in opposite directions to open and close the covering; the first drive wheel being adapted to rotate in opposite directions and being connected to the driven blind member, so that the driven blind member rotates with the first drive wheel;

a second drive wheel (9,109,209, 309, 409, 509, 609,709) that is adapted to rotate in opposite directions within the housing, is rotatably connected to the housing (3,103,203, 303, 403, 503,603,703) and is operatively connected to the first drive wheel (7,107,207, 307, 407, 507, 607,707), so that the first drive wheel rotates with the second drive wheel; and an operating cord (11,111,211, 311, 411, 511,611,711) that is an endless loop and is looped over the second drive wheel (9,109,209, 309, 409, 509,609,709) and has first and second, cord portions (31,131,231, 331, 431, 531, 631,731 and 33,133,233, 333, 433, 533,633,733) depending from opposite sides of the second drive wheel, whereby an axial pulling force on only the first cord portion causes the second drive wheel to rotate in a first direction and an axial pulling force on only the second cord portion causes the second drive wheel to rotate in an opposite second direction; and release means (24A, 25A, 124A, 125A, 224A, 225A, 324A, 325A, 424A, 425A, 571, 573, 587, 589, 687, 689, 691, 693,800) for disconnecting, preferably non-destructively disconnecting, the second drive wheel (9,109,209,309,409, 509, 609,709) from the first drive wheel (7,107,207, 307, 407,507, 607,707) only when there is an axial pulling force on both the first and second cord portions (31,131,231, 331, 431, 531, 631, 731 and 33,133, 233, 333, 433, 533, 633, 733) simultaneously.

2. The control system of claim 1 wherein both the first and second drive wheels are rotatably mounted in the housing; and wherein the release means are for dismounting the second drive wheel from the housing when there is the axial pulling force on both the first and second cord portions simultaneously.

3. The control system of claim 2 wherein the release means comprise:

a pair of journals (25A,125A,225A) protruding from opposite sides of the second drive wheel (9,109,209) and located in a pair of complementary bearings (24A, 124A,224A) in walls (17,19,117,119,217,219) on opposite sides of the housing (3,103,203); or a pair of journals protruding from inner walls on opposite sides of the housing and located in a pair of complementary bearings in opposite sides of the second drive wheel; and wherein the journals or the bearings or both have beveled edges, whereby when there is an axial pulling force on both the first and second cord portions (31,131,231 and 33,133,233) simultaneously, the journals (25A, 125A, 225A) push apart the walls (17,19,117,119,217,219) of the housing and thus dismount the second drive wheel from the housing.

4. The control system of claim 3 wherein each bearing (24A, 224A) is a blind recess.

5. The control system of claim 4 wherein the blind recess (224A) is key-hole shaped and has an upper, generally circular portion (239) and a lower, downwardly-extending stem portion (241).

6. The control system of claim 1 wherein the second drive wheel (309, 409, 609, 709) is operatively connected to the first drive wheel (307, 407,607,709) by a third drive wheel (347, 447, 647, 747) and an auxiliary operating cord (349, 449, 649, 749).

7. The control system of claim 6 wherein both the second drive wheel (309, 409, 609, 709) and third drive wheel (347, 447, 647, 747) are rotatably mounted in the housing (303, 403, 603, 703); wherein the auxiliary drive cord (349, 449, 649, 747) is an endless loop and is looped over the first drive wheel (307, 407, 607, 707) and the third drive wheel (347, 447, 647, 747) operatively connects them; wherein when the second drive wheel is rotated, it causes the third drive wheel to rotate, which in turn causes the auxiliary operating cord to drive the first drive wheel into rotation and thus the driven member; and wherein the release means are for dismounting the second drive wheel from the housing when there is the axial pulling force on both the first and second cord portions simultaneously.

8. The control system of claim 7 wherein the release means comprise:

a pair of journals (325A, 425A) protruding from opposite sides of the second drive wheel (309, 409) and located in a pair of complementary bearings (324A, 424A) in walls (317, 319, 417, 419) on opposite sides of the housing (303, 403); or a pair of journals protruding from inner walls on opposite sides of the housing and located in a pair of complementary bearings in opposite sides of the second drive wheel; and wherein the journals or the bearings or both have beveled edges, whereby when there is an axial pulling force on both the first and second cord portions (331,431 and 333,433) simultaneously, the journals (325A,425A) push apart the walls (317,319,417,419) of the housing and thus dismount the second drive wheel from the housing.

9. The control system of claim 2 wherein the release means are for disconnecting a lower portion (515, 615) of the housing (503, 603), rotatably housing the lower drive wheel (509, 609), from an upper portion (513, 613) of the housing (503, 603), rotatably housing the upper drive wheel (507) or the intermediate drive wheel (647).

10. The control system of claim 9 wherein the release means comprise a releasable snap engagement between the upper and lower housing portions (513, 613, 515, 615).

11. The control system of claim 10, wherein said snap engagement comprises:

a pair of snap-lugs (587, 589) protruding from a pair of vertically extending cantilever beams (583, 585) placed opposite each other atop the lower housing portion, and located in a pair of slots (571, 573) in opposite inner surfaces of a pair of opposite wall members (521A, 521B) of the upper housing portion (513), and wherein the snap-lugs comprise retraction portions (587A, 589A) and the slots comprise complementary ledges (571A, 573A) and the retraction portions contact the ledges, whereby when there is an downward pulling force on both the first and second cord portions (531, 533) simultaneously, the contacting retraction portions and the ledges push the snap-lugs away from the slots and thus dismount the lower housing portion form the upper housing portion.

12. The control system of claim 10, wherein said snap engagement comprises:

a front and back snap-lug (687, 689) protruding from a front and back, vertically-extending cantilever beam (683, 685)

the front cantilever beam (683) extending upward from atop the lower housing portion, and back cantilever beam (695) extending downward from the bottom of the upper housing portion, a front lug retainer (695) on the upper housing portion (613) and back lug retainer (697) on the lower housing portion (615) and wherein the snap-lugs (687,689) comprise retraction portions (687A, 689A) contacting the lug retainers, and whereby when there is an downward pulling force on both the first and second cord portions 631,633 simultaneously, the contacting retraction portions and lug retainers push the snap-lugs away from the retainers and thus dismount the lower housing portion form the upper housing portion.

13. The control system of claim 8 wherein the release means are for disconnecting a lower portion (515, 615) of the housing (503, 603), rotatably housing the lower drive wheel (509, 609), from an upper portion (513, 613) of the housing (503, 603), rotatably housing the upper drive wheel (507) or the intermediate drive wheel (647).

14. The control system of claim 13 wherein the release means comprise a releasable snap engagement between the upper and lower housing portions (513, 613, 515, 615).

15. The control system of claim 14, wherein said snap engagement comprises:

a pair of snap-lugs (587, 589) protruding from a pair of vertically extending cantilever beams (583, 585) placed opposite each other atop the lower housing portion, and located in a pair of slots (571, 573) in opposite inner surfaces of a pair of opposite wall members (521A, 521B) of the upper housing portion (513), and wherein the snap-lugs comprise retraction portions (587A, 589A) and the slots comprise complementary ledges (571A, 573A) and the retraction portions contact the ledges, whereby when there is an downward pulling force on both the first and second cord portions (531, 533) simultaneously, the contacting retraction portions and the ledges push the snap-lugs away from the slots and thus dismount the lower housing portion form the upper housing portion.

16. The control system of claim 14, wherein said snap engagement comprises:

a front and back snap-lug (687, 689) protruding from a front and back, vertically-extending cantilever beam (683, 685)

the front cantilever beam (683) extending upward from atop the lower housing portion, and back cantilever beam (695) extending downward from the bottom of the upper housing portion, a front lug retainer (695) on the upper housing portion (613) and back lug retainer (697) on the lower housing portion (615) and wherein the snap-lugs (687,689) comprise retraction portions (687A, 689A) contacting the lug retainers, and whereby when there is an downward pulling force on both the first and second cord portions 631,633 simultaneously, the contacting retraction portions and lug retainers push the snap-lugs away from the retainers and thus dismount the lower housing portion form the upper housing portion.

17. The control system of claim 6 wherein the second drive wheel (709) and the third drive wheel (747) are coaxially connected.

18. The control system of claim 17 wherein the second and third drive wheels (709, 747) are coaxially connected by a releasable snap fit means (800) and the release means are the releasable snap fit means.

19. The control system of claim 18 wherein the snap fit means comprise:

a pair of snap lugs (805, 807) protruding from a pair of horizontally-extending cantilever beams (801,803) placed opposite each other on an inner circumferential surface (747E) surrounding a central axial opening (747F) of the third drive wheel (747), and located in a pair of slots (809,811) opposite each other in an inner circumferential surface (709E) surrounding a central axial opening 709F of the second drive wheel (709), and wherein the snap-lugs comprise retraction portions (805B, 807B) and the slots comprise complementary ledges (809C, 811C) and the retraction portions contact the ledges, whereby when there is a downward pulling force on both the first and second cord portions (731, 733) simultaneously, the contacting retraction portions and the ledges push the snap-lugs away from the slots and thus dismount the second drive wheel (709) from the third drive wheel (747).

20. The control system of claim 19 wherein the cantilever beams have a generally C-shape and the snap-lug is on a closed section of the C-shape and the legs of the C-shape extend from the inner circumferential surface (747E) of the third drive wheel.

21. A covering for an architectural opening, such as a venetian blind, which includes a control system of any one of claims 1–20.

* * * * *